US009671715B2

(12) United States Patent
Yano et al.

(10) Patent No.: US 9,671,715 B2
(45) Date of Patent: Jun. 6, 2017

(54) OPTICAL WRITING DEVICE AND IMAGE FORMING DEVICE

(71) Applicant: KONICA MINOLTA, INC., Chiyoda-ku, Tokyo (JP)

(72) Inventors: So Yano, Ibaraki (JP); Yasushi Nagasaka, Okazaki (JP); Masayuki Iijima, Okazaki (JP); Takahiro Matsuo, Toyokawa (JP); Takaki Uemura, Seto (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/932,391

(22) Filed: Nov. 4, 2015

(65) Prior Publication Data

US 2016/0131989 A1 May 12, 2016

(30) Foreign Application Priority Data

Nov. 11, 2014 (JP) ..... 2014-228862

(51) Int. Cl.
*G03G 15/04* (2006.01)
*B41J 2/45* (2006.01)
*G03G 15/043* (2006.01)

(52) U.S. Cl.
CPC ..... *G03G 15/043* (2013.01); *G03G 15/04045* (2013.01); *G03G 15/04063* (2013.01)

(58) Field of Classification Search
CPC B41J 2/45; G03G 15/04045; G03G 15/04063
See application file for complete search history.

(56) References Cited

U.S. PATENT DOCUMENTS 6,184,971 B1 * 2/2001 Narita ..... B41J 2/45 347/238
2007/0188583 A1 * 8/2007 Nomura ..... B41J 2/45 347/132

FOREIGN PATENT DOCUMENTS

JP 04-336557 11/1992
JP 08-216448 A 8/1996
(Continued)

OTHER PUBLICATIONS

Official Action issued in corresponding Japanese Patent Application No. 2014-228862; dated Oct. 25, 2016, with English Translation (5 pages).

*Primary Examiner* — Matthew Luu
*Assistant Examiner* — Patrick King
(74) *Attorney, Agent, or Firm* — Buchanan Ingersoll & Rooney PC

(57) ABSTRACT

An optical writing device performing optical writing onto a photoreceptor, including: a light-emitting unit including a plurality of light-emitting elements that form a plurality of element rows spaced from one another in a sub scanning direction, each of the light-emitting elements having a main scanning direction position differing from a main scanning direction position of any other one of the light-emitting elements; a plurality of signal output units, one for each element row, each outputting a light amount signal for each light-emitting element in a corresponding element row, each light amount signal indicating an amount of light to be emitted by a corresponding light-emitting element; and a plurality of drive units, one for each light-emitting element, each, when receiving a light amount signal for a corresponding light-emitting element, supplying a drive current in accordance with the light amount signal to the corresponding light-emitting element.

19 Claims, 14 Drawing Sheets

(56) References Cited

FOREIGN PATENT DOCUMENTS

| | | | |
|---|---|---|---|
| JP | 10-329355 | | 12/1998 |
| JP | 3029638 | B2 | 4/2000 |
| JP | 2001-284653 | | 10/2001 |
| JP | 4100191 | B2 | 6/2008 |
| JP | 2008-176093 | | 7/2008 |
| JP | 2010-023482 | | 2/2010 |
| JP | 2014-062967 | | 4/2014 |

* cited by examiner

FIG. 9

Source image data
Main scan: 14,032 dots

| | Main Scanning Direction Arrangement Position of Light-emitting Elements | | | | | | | | | |
|---|---|---|---|---|---|---|---|---|---|---|
| | 1 | 2 | 3 | 4 | 5 | 6 | 7 | 8 | 9 | ··· |
| 1H | 50 | 45 | 60 | 65 | 51 | 46 | 61 | 66 | 52 | ··· |
| 2H | 55 | 45 | 60 | 65 | 56 | 46 | 61 | 66 | 57 | ··· |
| 3H | 50 | 45 | 60 | 65 | 51 | 46 | 61 | 66 | 52 | ··· |
| 4H | 50 | 45 | 60 | 65 | 51 | 46 | 61 | 66 | 52 | ··· |
| 5H | 50 | 45 | 60 | 65 | 51 | 46 | 61 | 66 | 52 | ··· |
| 6H | 50 | 45 | 60 | 65 | 51 | 46 | 61 | 66 | 52 | ··· |
| 7H | 50 | 45 | 60 | 65 | 51 | 46 | 61 | 66 | 52 | ··· |
| 8H | 50 | 45 | 60 | 65 | 51 | 46 | 61 | 66 | 52 | ··· |
| 9H | 50 | 45 | 60 | 65 | 51 | 46 | 61 | 66 | 52 | ··· |
| 10H | 50 | 45 | 60 | 65 | 51 | 46 | 61 | 66 | 52 | ··· |
| 11H | 50 | 45 | 60 | 65 | 51 | 46 | 61 | 66 | 52 | ··· |
| 12H | 50 | 45 | 60 | 65 | 51 | 46 | 61 | 66 | 52 | ··· |
| 13H | 50 | 45 | 60 | 65 | 51 | 46 | 61 | 66 | 52 | ··· |
| 14H | 50 | 45 | 60 | 65 | 51 | 46 | 61 | 66 | 52 | ··· |
| 15H | 50 | 45 | 60 | 65 | 51 | 46 | 61 | 66 | 52 | ··· |
| 16H | 50 | 45 | 60 | 65 | 51 | 46 | 61 | 66 | 52 | ··· |
| 17H | 50 | 45 | 60 | 65 | 51 | 46 | 61 | 66 | 52 | ··· |
| 18H | 50 | 45 | 60 | 65 | 51 | 46 | 61 | 66 | 52 | ··· |
| 19H | 50 | 45 | 60 | 65 | 51 | 46 | 61 | 66 | 52 | ··· |
| 20H | 50 | 45 | 60 | 65 | 51 | 46 | 61 | 66 | 52 | ··· |
| 21H | 50 | 45 | 60 | 65 | 51 | 46 | 61 | 66 | 52 | ··· |
| 22H | 50 | 45 | 60 | 65 | 51 | 46 | 61 | 66 | 52 | ··· |
| 23H | 50 | 45 | 60 | 65 | 51 | 46 | 61 | 66 | 52 | ··· |
| 24H | 60 | 45 | 60 | 65 | 51 | 46 | 61 | 66 | 52 | ··· |
| 25H | 50 | 45 | 60 | 65 | 51 | 46 | 61 | 66 | 52 | ··· |
| 26H | 50 | 45 | 60 | 65 | 51 | 46 | 61 | 66 | 52 | ··· |
| 27H | 50 | 45 | 60 | 65 | 51 | 46 | 61 | 66 | 52 | ··· |
| 28H | 50 | 45 | 60 | 65 | 51 | 46 | 61 | 66 | 52 | ··· |
| 29H | 50 | 45 | 60 | 65 | 51 | 46 | 61 | 66 | 52 | ··· |
| 30H | 50 | 45 | 60 | 65 | 51 | 46 | 61 | 66 | 52 | ··· |
| 31H | 50 | 45 | 60 | 65 | 51 | 46 | 61 | 66 | 52 | ··· |
| 32H | 50 | 45 | 60 | 65 | 51 | 46 | 61 | 66 | 52 | ··· |
| 33H | 50 | 45 | 60 | 65 | 51 | 46 | 61 | 66 | 52 | ··· |
| 34H | 50 | 45 | 60 | 65 | 51 | 46 | 61 | 66 | 52 | ··· |
| 35H | 50 | 45 | 60 | 65 | 51 | 46 | 61 | 66 | 52 | ··· |
| 36H | 50 | 45 | 60 | 65 | 51 | 46 | 61 | 66 | 52 | ··· |
| 37H | 50 | 45 | 60 | 65 | 51 | 46 | 61 | 66 | 52 | ··· |
| 38H | 50 | 45 | 60 | 65 | 51 | 46 | 61 | 66 | 52 | ··· |
| 39H | 50 | 45 | 60 | 65 | 51 | 46 | 61 | 66 | 52 | ··· |
| 40H | 50 | 45 | 60 | 65 | 51 | 46 | 61 | 66 | 52 | ··· |
| 41H | 50 | 45 | 60 | 65 | 51 | 46 | 61 | 66 | 52 | ··· |
| 42H | 50 | 45 | 60 | 65 | 51 | 46 | 61 | 66 | 52 | ··· |
| 43H | 50 | 45 | 60 | 65 | 51 | 46 | 61 | 66 | 52 | ··· |
| ··· | ··· | ··· | ··· | ··· | ··· | ··· | ··· | ··· | ··· | ··· |
| 19,843H | 50 | 45 | 60 | 65 | 51 | 46 | 61 | 66 | 52 | ··· |

FIG. 10

Image Data for Printing per Light-emitting Element Array

| | Arrangement position of light-emitting elements | | | | Arrangement position of light-emitting elements | | | | Arrangement position of light-emitting elements | | | | Arrangement position of light-emitting elements | | | |
|---|---|---|---|---|---|---|---|---|---|---|---|---|---|---|---|---|
| | 1 | 5 | 9 | ··· | 2 | 6 | 10 | ··· | | 7 | 11 | ··· | 4 | 8 | 12 | ··· |
| 1H | 50 | 51 | 52 | ··· | 45 | 46 | 47 | ··· | 60 | 61 | 62 | ··· | 65 | 66 | 67 | ··· |
| 2H | 55 | 56 | 57 | ··· | 45 | 46 | 47 | ··· | 60 | 61 | 62 | ··· | 65 | 66 | 67 | ··· |
| 3H | 50 | 51 | 52 | ··· | 45 | 46 | 47 | ··· | 60 | 61 | 62 | ··· | 65 | 66 | 67 | ··· |
| 4H | 50 | 51 | 52 | ··· | 45 | 46 | 47 | ··· | 60 | 61 | 62 | ··· | 65 | 66 | 67 | ··· |
| 5H | 50 | 51 | 52 | ··· | 45 | 46 | 47 | ··· | 60 | 61 | 62 | ··· | 65 | 66 | 67 | ··· |
| 6H | 50 | 51 | 52 | ··· | 45 | 46 | 47 | ··· | 60 | 61 | 62 | ··· | 65 | 66 | 67 | ··· |
| 7H | 50 | 51 | 52 | ··· | 45 | 46 | 47 | ··· | 60 | 61 | 62 | ··· | 65 | 66 | 67 | ··· |
| 8H | 50 | 51 | 52 | ··· | 45 | 46 | 47 | ··· | 60 | 61 | 62 | ··· | 65 | 66 | 67 | ··· |
| 9H | 50 | 51 | 52 | ··· | 45 | 46 | 47 | ··· | 60 | 61 | 62 | ··· | 65 | 66 | 67 | ··· |
| 10H | 50 | 51 | 52 | ··· | 45 | 46 | 47 | ··· | 60 | 61 | 62 | ··· | 65 | 66 | 67 | ··· |
| 11H | 50 | 51 | 52 | ··· | 45 | 46 | 47 | ··· | 60 | 61 | 62 | ··· | 65 | 66 | 67 | ··· |
| 12H | 50 | 51 | 52 | ··· | 45 | 46 | 47 | ··· | 60 | 61 | 62 | ··· | 65 | 66 | 67 | ··· |
| 13H | 50 | 51 | 52 | ··· | 45 | 46 | 47 | ··· | 60 | 61 | 62 | ··· | 65 | 66 | 67 | ··· |
| 14H | 50 | 51 | 52 | ··· | 45 | 46 | 47 | ··· | 60 | 61 | 62 | ··· | 65 | 66 | 67 | ··· |
| 15H | 50 | 51 | 52 | ··· | 45 | 46 | 47 | ··· | 60 | 61 | 62 | ··· | 65 | 66 | 67 | ··· |
| 16H | 50 | 51 | 52 | ··· | 45 | 46 | 47 | ··· | 60 | 61 | 62 | ··· | 65 | 66 | 67 | ··· |
| 17H | 50 | 51 | 52 | ··· | 45 | 46 | 47 | ··· | 60 | 61 | 62 | ··· | 65 | 66 | 67 | ··· |
| 18H | 50 | 51 | 52 | ··· | 45 | 46 | 47 | ··· | 60 | 61 | 62 | ··· | 65 | 66 | 67 | ··· |
| 19H | 50 | 51 | 52 | ··· | 45 | 46 | 47 | ··· | 60 | 61 | 62 | ··· | 65 | 66 | 67 | ··· |
| 20H | 50 | 51 | 52 | ··· | 45 | 46 | 47 | ··· | 60 | 61 | 62 | ··· | 65 | 66 | 67 | ··· |
| 21H | 50 | 51 | 52 | ··· | 45 | 46 | 47 | ··· | 60 | 61 | 62 | ··· | 65 | 66 | 67 | ··· |
| ··· | ··· | ··· | ··· | ··· | ··· | ··· | ··· | ··· | ··· | ··· | ··· | ··· | ··· | ··· | ··· | ··· |
| 19,843H | 50 | 51 | 52 | ··· | 45 | 46 | 47 | ··· | 60 | 61 | 62 | ··· | 65 | 66 | 67 | ··· |
| | Data 81 for first zigzag tier | | | | Data 82 for second zigzag tier | | | | Data 83 for third zigzag tier | | | | Data 84 for fourth zigzag tier | | | |

19,843 dots

FIG. 12

Image Data for Printing Created with Offset Matching Print Timing

Main scan: 14,032 dots

Sub scan: 19,867 dots

| | Pixel position in main scanning direction | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | |
| 1H | 50 | | | | 51 | | | | 52 | | | | 71 | State 2 |
| 2H | 55 | | | | 56 | | | | 57 | | | | 71 | |
| 3H | 50 | | | | 51 | | | | 52 | | | | 71 | |
| 4H | 50 | | | | 51 | | | | 52 | | | | 71 | |
| 5H | 50 | | | | 51 | | | | 52 | | | | 71 | |
| 6H | 50 | | | | 51 | | | | 52 | | | | 71 | |
| 7H | 50 | | | | 51 | | | | 52 | | | | 71 | |
| 8H | 50 | | | | 51 | | | | 52 | | | | 71 | |
| 9H | 50 | 45 | | | 51 | 46 | | | 52 | 47 | | | 71 | State 3 |
| 10H | 50 | 45 | | | 51 | 46 | | | 52 | 47 | | | 71 | |
| 11H | 50 | 45 | | | 51 | 46 | | | 52 | 47 | | | 71 | |
| 12H | 50 | 45 | | | 51 | 46 | | | 52 | 47 | | | 71 | |
| 13H | 50 | 45 | | | 51 | 46 | | | 52 | 47 | | | 71 | |
| 14H | 50 | 45 | | | 51 | 46 | | | 52 | 47 | | | 71 | |
| 15H | 50 | 45 | | | 51 | 46 | | | 52 | 47 | | | 71 | |
| 16H | 50 | 45 | | | 51 | 46 | | | 52 | 47 | | | 71 | |
| 17H | 50 | 45 | 60 | | 51 | 46 | 61 | | 52 | 47 | 62 | | 71 | State 4 |
| 18H | 50 | 45 | 60 | | 51 | 46 | 61 | | 52 | 47 | 62 | | 71 | |
| 19H | 50 | 45 | 60 | | 51 | 46 | 61 | | 52 | 47 | 62 | | 71 | |
| 20H | 50 | 45 | 60 | | 51 | 46 | 61 | | 52 | 47 | 62 | | 71 | |
| 21H | 50 | 45 | 60 | | 51 | 46 | 61 | | 52 | 47 | 62 | | 71 | |
| 22H | 50 | 45 | 60 | | 51 | 46 | 61 | | 52 | 47 | 62 | | 71 | |
| 23H | 50 | 45 | 60 | | 51 | 46 | 61 | | 52 | 47 | 62 | | 71 | |
| 24H | 60 | 45 | 60 | | 51 | 46 | 61 | | 52 | 47 | 62 | | 71 | |
| 25H | 50 | 45 | 60 | 65 | 51 | 46 | 61 | 66 | 52 | 47 | 62 | 67 | 71 | State 5 |
| 26H | 50 | 45 | 60 | 65 | 51 | 46 | 61 | 66 | 52 | 47 | 62 | 67 | 71 | |
| ... | ... | ... | ... | ... | ... | ... | ... | ... | ... | ... | ... | ... | ... | |
| 19,843H | 50 | 45 | 60 | 65 | 51 | 46 | 61 | 66 | 52 | 47 | 62 | 67 | 71 | |
| 19,844H | | 45 | 60 | 65 | | 46 | 61 | 66 | | 47 | 62 | 67 | | State 6 |
| 19,845H | | 45 | 60 | 65 | | 46 | 61 | 66 | | 47 | 62 | 67 | | |
| ... | | ... | ... | ... | | ... | ... | ... | | ... | ... | ... | | |
| 19,850H | | 45 | 60 | 65 | | 46 | 61 | 66 | | 47 | 62 | 67 | | |
| 19,851H | | 45 | 60 | 65 | | 46 | 61 | 66 | | 47 | 62 | 67 | | |
| 19,852H | | | 60 | 65 | | | 61 | 66 | | | 62 | 67 | | State 7 |
| 19,853H | | | 60 | 65 | | | 61 | 66 | | | 62 | 67 | | |
| ... | | | ... | ... | | | ... | ... | | | ... | ... | | |
| 19,858H | | | 60 | 65 | | | 61 | 66 | | | 62 | 67 | | |
| 19,859H | | | 60 | 65 | | | 61 | 66 | | | 62 | 67 | | |
| 19,860H | | | | 65 | | | | 66 | | | | 67 | | State 8 |
| 19,861H | | | | 65 | | | | 66 | | | | 67 | | |
| ... | | | | ... | | | | ... | | | | ... | | |
| 19,866H | | | | 65 | | | | 66 | | | | 67 | | |
| 19,867H | | | | 65 | | | | 66 | | | | 67 | | |

Regions without image data

FIG. 13

| Writing state | State 1 | State 2 | State 3 | State 4 | State 5 | State 6 | State 7 | State 8 | State 1 |
|---|---|---|---|---|---|---|---|---|---|
| Description | No image data (before printing) | ・Image data present only in first tier<br>・No image data present in other tiers | ・Image data present only in first and second tiers<br>・No image data present in other tiers | ・Image data present in first, second, and third tiers<br>・No image data present in fourth tier | ・Image data present in all tiers | ・Image data present in second, third, and fourth tiers<br>・No image data present in first tier | ・Image data present in third and fourth tiers<br>・No image data present in first and second tiers | ・Image data present in fourth tier<br>・No image data present in first, second, and third tiers | No image data (printing complete) |

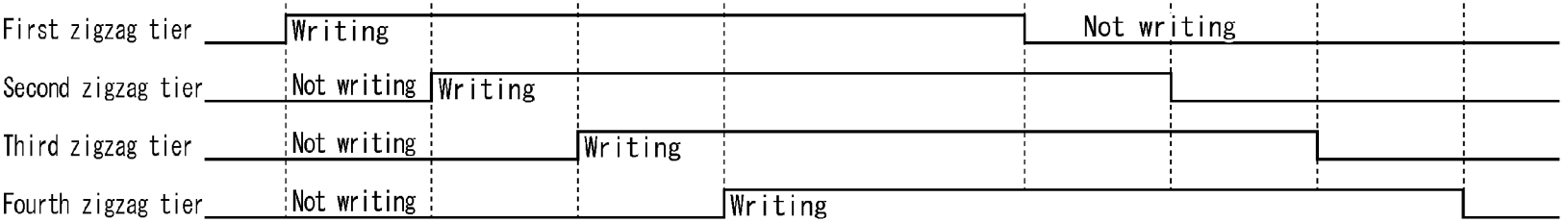

OPTICAL WRITING DEVICE AND IMAGE FORMING DEVICE

This application is based on an application No. 2014-228862 filed in Japan, the contents of which are hereby incorporated by reference.

BACKGROUND OF THE INVENTION (1) Field of the Invention

The present disclosure pertains to an optical writing device performing optical writing onto a photoreceptor, and to an image forming device equipped therewith.

(2) Description of the Related Art

An image forming device, such as a printer, uses an optical writing unit writing an image to a photoreceptor with an optical beam emitted from light-emitting elements, which are provided as a plurality of tiny light-emitting elements aligned linearly.

As an example of such an optical writing unit, Japanese Patent Application Publication No. H8-216448 discloses a configuration having a plurality of light-emitting elements aligned in a single line in a main scanning direction, and a switch element provided for each of the light-emitting elements. Each of the switch elements switches between supplying and interrupting a drive current to the corresponding light-emitting element. In this configuration, the light-emitting elements are caused to emit light in alignment order by the respective switch elements consecutively being switched ON by a clock pulse signal.

The optical writing unit may be configured with the smallest spacing possible between neighboring light-emitting elements in the main scanning direction in order to achieve high resolution in the main scanning direction of the formed image. However, as described above, a configuration in which the light-emitting elements are aligned in a single line in the main scanning direction imposes a lower limit on the size of the spacing.

As such, as illustrated in FIG. 16, a configuration has been proposed in which a plurality of light-emitting elements 90 are divided into four lines 911 through 914 and aligned in zigzags along the main scanning direction. In the following, reference signs 90-1, 90-1, 90-3, . . . 90-N are used wherever necessary to distinguish among the light-emitting elements 90, in zigzag arrangement order. Optical beams from the light-emitting elements 90 in the light-emitting element arrays 911 through 914 perform writing of an image onto a photoreceptor drum 920, which is rotating in the direction indicated by arrow J.

Given the configuration in which N of the light-emitting elements 90 are arranged in zigzags, a greater quantity of the light-emitting elements 90 is arranged per unit length in the main scanning direction relative to a conventional array configuration.

Accordingly, a pitch interval in the main scanning direction of beam spots 921, produced by the optical beams emitted from the light-emitting elements 90, on the photoreceptor drum 920 is made smaller than in the conventional configuration disclosed in Japanese Patent Application Publication No. H8-216448. That is, the resolution in the main scanning direction is increased.

In this zigzag configuration, the arrangement positions of the light-emitting element arrays 911 through 914 are offset in a sub scanning direction. As a result, once the light-emitting elements 90-1 through 90-N are caused to emit light in each main scanning line using image data from an original image, as-is, a phenomenon occurs in that, for an expected image of one main scanning line from the original image on the photoreceptor drum 920, beam spots 922 (dashed lines) are illuminated at positions offset in the sub scanning direction due to the arrangement positions of the light-emitting element arrays 911 through 914, not producing a single main scanning line 931. In order to prevent this phenomenon, light emission timing may be offset by a time (hereinafter, Δt) corresponding to an offset Δd of the arrangement position in the sub scanning direction among neighboring light-emitting elements 90, for instance light-emitting element 90-2 relative to light-emitting element 90-1, light-emitting element 90-3 relative to light-emitting element 90-2, and so on.

Incidentally, this offset in light emission timing requires control to individually switch the light-emitting elements 90 belonging to each of the light-emitting element arrays between emitting light and being extinguished.

For example, with attention to light-emitting elements 90-1 through 90-4, during a period from writing start for one page to time Δt, light-emitting elements 90-2 through 90-4 must be forcibly extinguished while light-emitting element 90-1 is emitting light (state A). This extinguishing is required because otherwise, an image not present in the original image would be written.

Once time Δt has elapsed since writing start, there is a transition to state B, in which light-emitting element 90-2 emits light and light-emitting elements 90-3, 90-4 remain extinguished. Once time Δt has elapsed again, there is a transition to state C, in which light-emitting element 90-3 emits light and light-emitting element 90-4 remains extinguished. Once time Δt has elapsed yet again, there is a transition to state D, in which light-emitting element 90-4 emits light. The transition to each state must also occur at the end of the writing of the page. The same also applies to the other light-emitting elements 1-5 through 1-N.

For each transition, from state A to state B, from state B to state C, and so on, a different quantity of the light-emitting elements is forcibly extinguished. As such, executing the transition to each state requires the output of a signal to all of the light-emitting elements for maintaining the current state until the transition to the next state, while the quantity of light-emitting elements forcibly extinguished in each state changes over time.

Assembling a single output circuit with functions for managing the switching of these state transitions requires a complex configuration that incorporates multiple tiers of logic gates and so on.

Supposing that the total quantity of the light-emitting elements 90 is 16 000, and that each output circuit is responsible for one hundred of the light-emitting elements, then experience suggests that each output circuit requires 500 logic gates in order to manage the switching of the states as described above, increasing the overall circuit scale to 80 000 gates. Increasing the quantity of gates embedded in a semiconductor element increases the size of the semiconductor element, which leads to increased costs. This problem is not limited to image forming devices, and occurs generally in optical writing devices performing optical writing on a photoreceptor.

SUMMARY OF THE INVENTION

The present disclosure aims to provide an optical writing device enabling circuit scale to be reduced, and an image forming device equipped therewith.

In view of this, one aspect of the present disclosure is an optical writing device performing optical writing onto a photoreceptor, including: a light-emitting unit including a plurality of light-emitting elements that form a plurality of element rows spaced from one another in a sub scanning direction, each of the light-emitting elements having a main scanning direction position differing from a main scanning direction position of any other one of the light-emitting elements; a plurality of signal output units, one for each element row, each signal output unit outputting a light amount signal for each light-emitting element in a corresponding element row, each light amount signal indicating an amount of light to be emitted by a corresponding light-emitting element; and a plurality of drive units, one for each light-emitting element, each drive unit, when receiving a light amount signal for a corresponding light-emitting element, supplying a drive current in accordance with the light amount signal to the corresponding light-emitting element.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 9 is a schematic diagram illustrating a configuration example of source image data of an original image;

FIG. 10 is a schematic diagram illustrating a configuration example of image data for printing;

FIG. 12 is a schematic diagram illustrating a configuration example of the image data for printing in a situation where a method from a comparative example is used;

FIG. 13 represents contents of each state among states 1 through 8 in a tabular form;

DESCRIPTION OF THE PREFERRED EMBODIMENTS

Embodiments of an optical writing device and an image forming device pertaining to the present disclosure are described below, using a tandem color printer (hereinafter simply termed a printer) as an example.

Embodiment 1

(Overall Printer Configuration)

Figure 1:
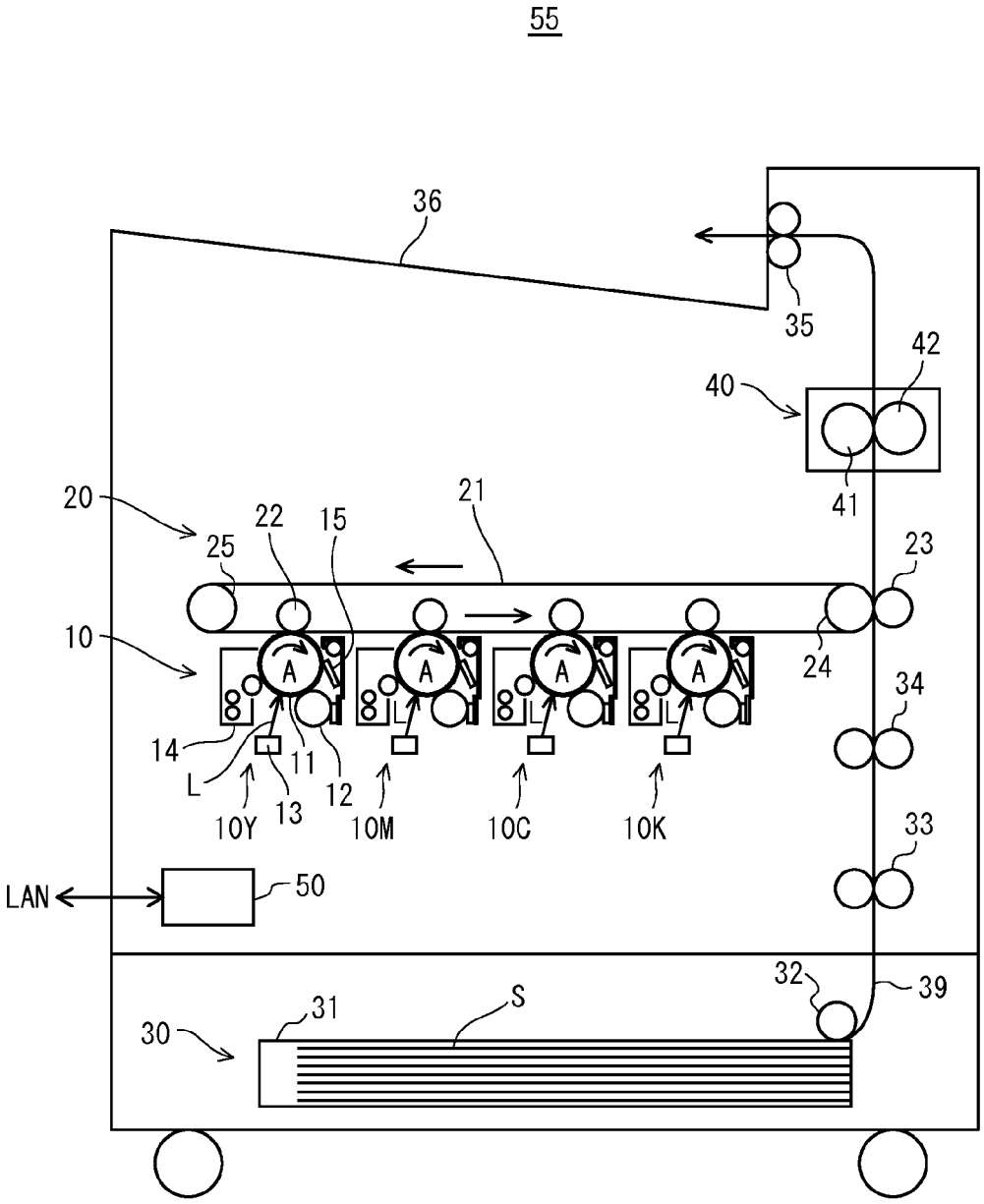
FIG. 1 is a diagram illustrating the configuration of a printer pertaining to a first embodiment.

FIG. 1 is a schematic view diagram illustrating the overall configuration of a printer 55 pertaining to the present embodiment.

As illustrated, the printer 55 forms an image using an electrophotographic scheme, and is equipped with an image processing unit 10, an intermediate transfer unit 20, a feed unit 30, a fixing unit 40, and a control unit 50. The printer 55 executes image formation (i.e., printing) in color, in accordance with a job execution request from an external terminal device (not diagrammed) received via a network (e.g., a local area network (hereinafter, LAN).

The image processing unit 10 includes imaging units 10Y, 10M, 10C, 10K respectively corresponding to reproduction colors yellow (hereinafter, Y), magenta (hereinafter, M), cyan (hereinafter, C), and black (hereinafter, K).

The imaging unit 10Y includes a photoreceptor drum 11 serving as an image carrier, as well as a charging unit 12, an exposure unit 13, a developing unit 14, a cleaner 15, and so on, disposed around the photoreceptor drum 11.

The charging unit 12 charges a circumferential surface of the photoreceptor drum 11, which rotates in the direction indicated by arrow A.

The exposure unit (optical writing unit) 13 exposes the photoreceptor drum 11, once charged, to an optical beam L, and forms a latent static image on the photoreceptor drum 11. The exposure unit 13 also includes a print head in which a plurality of current driven organic electroluminescence elements (hereinafter, organic light-emitting diodes (OLEDs)) are arranged on substrate in a zigzag pattern along a rotational axis direction of the photoreceptor drum 11 (hereinafter termed a main scanning direction). The OLEDs are hereinafter referred to as light-emitting elements. The configuration of the print head is described later.

The developing unit 14 develops the latent static image on the photoreceptor drum 11 with Y color toner. As a result, a Y color toner image is formed on the photoreceptor drum 11. The Y color toner image, once formed, undergoes a primary transfer onto an intermediate transfer belt 21 of the intermediate transfer unit 20. The cleaner 15 cleans excess toner from the photoreceptor drum 11 after the primary transfer. The other imaging units 10M, 10C, 10K are configured identically to the imaging unit 10Y, and reference signs for the components thereof are omitted from FIG. 1.

The intermediate transfer unit 20 includes the intermediate transfer belt 21, which is suspended across a driving roller 24 and a driven roller 25 and circulates in the direction of the arrows, a primary transfer roller 22 disposed opposite the respective photoreceptor drums 11 of the imaging units 10Y, 10M, 10C, 10K across the intermediate transfer belt 21, and a secondary transfer roller 23 disposed opposite the driving roller 24 across the intermediate transfer belt 21.

The feed unit 30 includes a cassette 31 containing sheets, in this case paper S, a feed roller 32 feeding the paper S one sheet at a time from the cassette 31 to a transport channel 39, and transport rollers 33, 34 transporting the paper S that has been fed.

The fixing unit 40 includes a fixing roller 41 and a pressing roller 42 pressed by the fixing roller 41.

The control unit 50 performs unified control of the operations of the image processing unit 10, the intermediate transfer unit 20, the feed unit 30, and the fixing unit 40, and smoothly executes each job. The control unit performs the following operations during job execution.

Specifically, using a brightness signal output unit 51 (see FIG. 3), the control unit 50 generates a light amount signal (hereinafter termed a brightness signal) indicating an amount of light (i.e., brightness) for each of the plurality of light-emitting elements arranged in the respective exposure unit 13 of each of the imaging units 10Y, 10M, 10C, 10K, in accordance with image data for printing included in the received job. This brightness signal is a digital signal, and is transmitted to the respective exposure units 13.

Each exposure unit 13 converts the digital brightness signal received thereby into an analog voltage brightness signal, then emits the optical beam L from the light-emitting elements with an amount of light corresponding to the converted brightness signal.

For each imaging unit 10Y, 10M, 10C, 10K, a latent static image is formed by the optical beam L emitted from the light-emitting elements of the exposure unit 13 on the photoreceptor drum 11 after charging. The latent static images are each used to form a toner image with toner. The respective toner images each undergo the primary transfer onto the intermediate transfer belt 21 through electrostatic action of the primary transfer roller 22.

The imaging operations, performed in the respective colors by the imaging units 10Y, 10M, 10C, 10K, are executed with timing offset from an upstream side to a downstream side so that the toner image in each color is transferred to the same overlapping position on the intermediate transfer belt 21, which is circulating.

The feed unit 30 has the paper S transported from the cassette 31 toward the secondary transfer roller 23 in coordination with the timing of the imaging. As such, the toner images, having undergone the overlapping transfer onto the intermediate transfer belt 21, undergo a secondary transfer all at once through the electrostatic action of the secondary transfer roller 23 upon passing of the paper S between the secondary transfer roller 23 and the intermediate transfer belt 21.

Once the toner images have undergone the secondary transfer, the paper S is transported to the fixing unit 40, where heat and pressure are applied thereto upon passing between the fixing roller 41 and the pressing roller 42 of the fixing unit 40, thereby fusing the toner on the paper S with the paper S. The paper S, having passed through the fixing unit 40, is expelled onto an exit tray 36 by an exit roller 35.

(Print Head Configuration)

Figure 2:
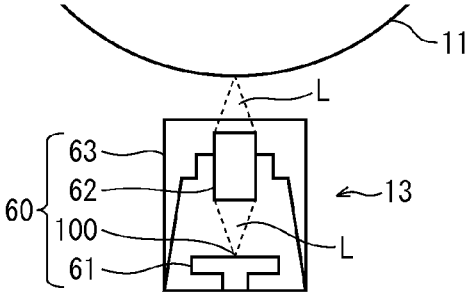
FIG. 2 is a diagram illustrating the schematic configuration of a print head for an exposure unit of the printer.

FIG. 2 is a diagram illustrating the overall configuration of a print head 60 in the exposure unit 13.

As illustrated, the print head 60 includes an OLED panel 61, a rod lens array 62, and a casing 63 containing these components.

The OLED panel 61 includes a light-emitting unit 100 made up of a plurality of light-emitting elements arranged in a zigzag pattern along the main scanning direction. These light-emitting elements each emit an individual optical beam L.

The rod lens array 62 is arranged between the light-emitting unit 100 and the photoreceptor drum 11, and condenses the individual optical beams L emitted by the light-emitting elements onto the photoreceptor drum 11.

(OLED Panel Configuration)

Figure 3:
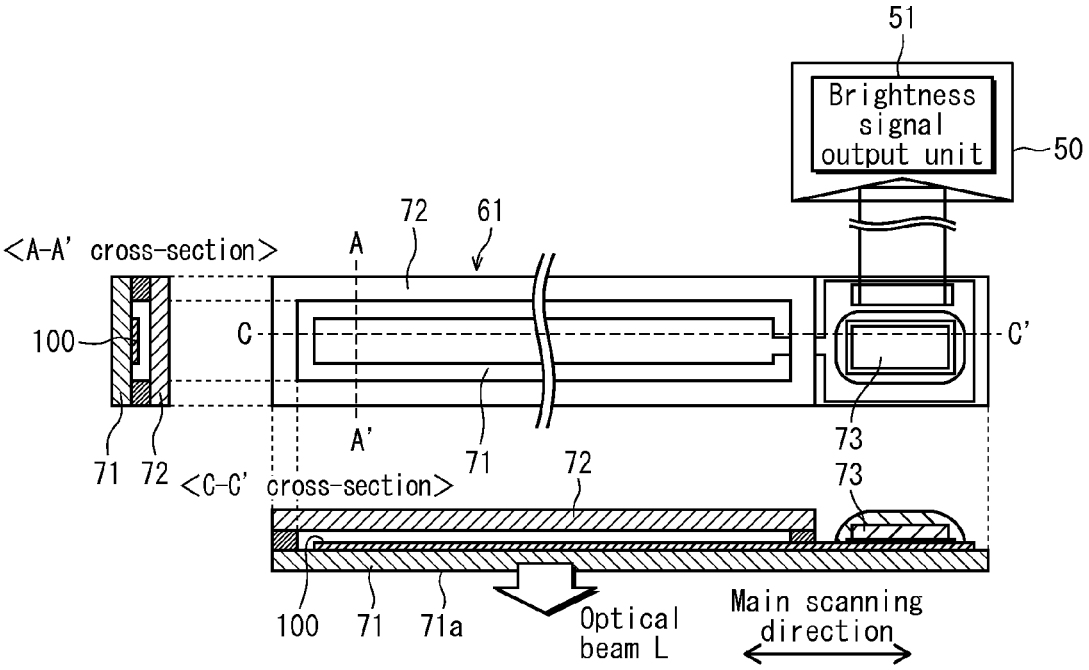
FIG. 3 is a schematic plan view and cross-sectional view of an OLED panel within the print head.

FIG. 3 is a schematic plan view of the OLED panel 61, combined with a cross-sectional view along line A-A' and a cross-sectional view along line C-C'.

The OLED panel 61 illustrated in FIG. 3 includes a thin film transistor (hereinafter, TFT) substrate 71, a sealing plate 72, and a source integrated circuit (hereinafter, IC) 73.

Along with the light-emitting unit 100, the TFT substrate 71 is provided with a set of one later-described drive circuit, one holding element, one switch, and so on for each of the light-emitting elements in the light-emitting unit 100. These components form a circuit configuration on a single TFT substrate 71. The optical beams L emitted from the light-emitting elements pass through the TFT substrate 71 and are emitted from a surface 71*a* of the TFT substrate 71, on an opposite side relative to a side where the light-emitting unit 100 is arranged.

The sealing plate 72 seals an arrangement region of the light-emitting unit 100 on the TFT substrate 71 to prevent contact with the atmosphere.

The source IC 73 is mounted in a region on the TFT substrate 71 other than the region where the sealing plate 72 is disposed, and includes a digital-to-analog converter (hereinafter, DAC) converting the digital brightness signal output from the brightness signal output unit 51 of the control unit 50 into the analog voltage brightness signal indicating the amount of light for each of the light-emitting elements, as well as a later-described shift register and so on.

(Light-Emitting Unit 100 Configuration)

Figure 4:
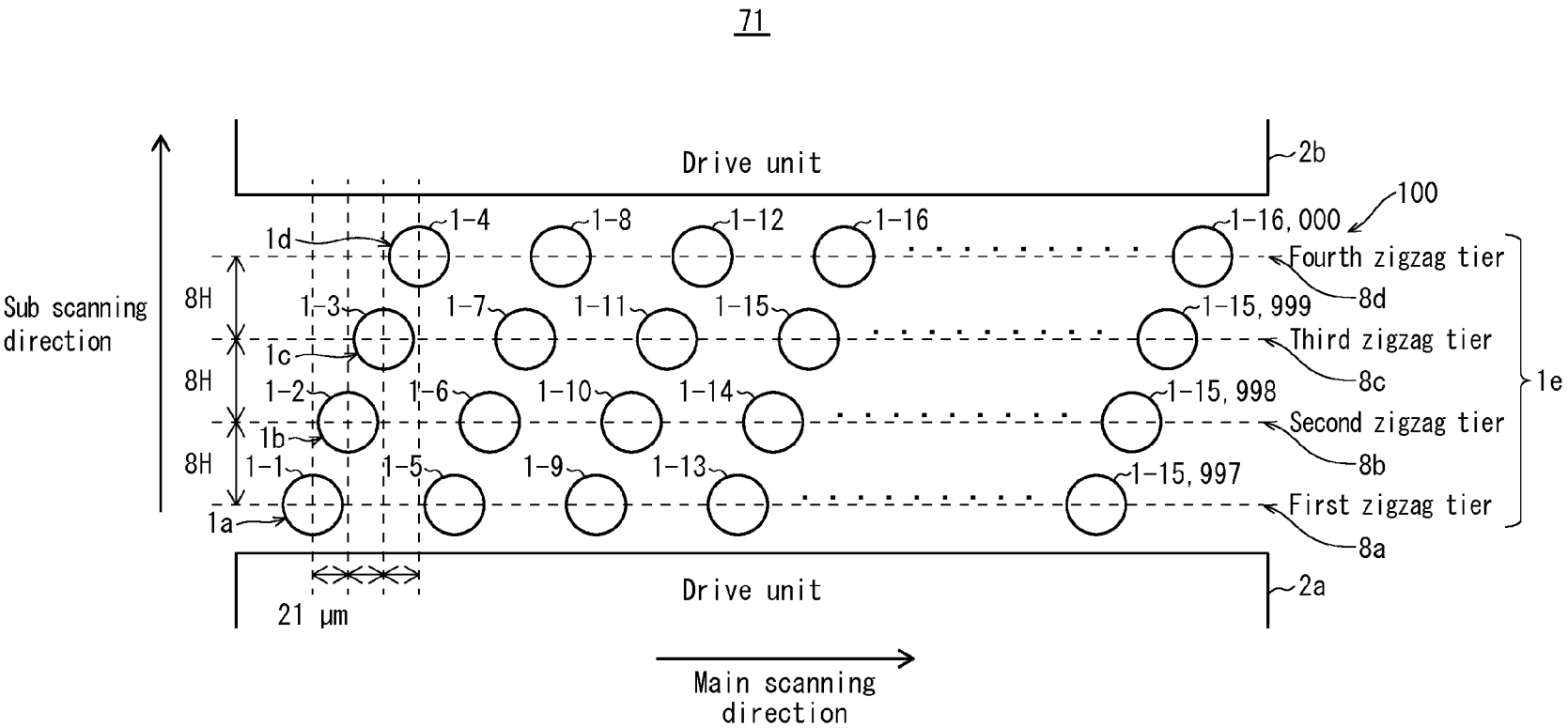
FIG. 4 is a plan view explaining the arrangement of light-emitting elements on a TFT substrate.

FIG. 4 is a plan view diagram explaining the arrangement of light-emitting elements 1 configuring the light-emitting unit 100 on the TFT substrate 71.

As illustrated, the light-emitting unit 100 includes a light-emitting element array 8*a* in which a plurality of light-emitting elements 1*a* are arranged in a linear shape along the main scanning direction, a light-emitting element array 8*b* in which a plurality of light-emitting elements 1*b* are arranged in a linear shape along the main scanning direction, a light-emitting element array 8*c* in which a plurality of light-emitting elements 1*c* are arranged in a linear shape along the main scanning direction, and a light-emitting element array 8*d* in which a plurality of light-emitting elements 1*d* are arranged in a linear shape along the main scanning direction. The light-emitting element arrays 8*a*-8*d* are aligned along a sub scanning direction.

Each arrangement of the light-emitting elements 1*a*, 1*b*, 1*c*, 1*d* differs in terms of arrangement position along the main scanning direction, forming a zigzag shape along the main scanning direction as seen in a plan view.

The term light-emitting elements 1 is used below when there is no particular need to distinguish among the light-emitting elements 1*a*, 1*b*, 1*c*, 1*d*. In addition, in a situation where the light-emitting elements 1 are distinguished in terms of where they are arranged along the main scanning direction, the illustrated ordering is used. For example, the light-emitting elements are numbered 1-1, 1-2, 1-3, . . . 1-15999, 1-16000. Furthermore, in certain cases, light-emitting element array 8*a* is termed a first zigzag tier, light-emitting element array 8*b* is termed a second zigzag tier, light-emitting element array 8*c* is termed a third zigzag tier, and light-emitting element array 8*d* is termed a fourth zigzag tier.

The light-emitting elements 1 are each formed identically in terms of shape, size, materials, and so on, and have identical properties. For example, given a resolution in the main scanning direction of 1200 dots per inch (hereinafter, dpi) (21 μm pitch) and a resolution in the sub scanning direction of 2400 dpi (10.6 μm pitch), the light-emitting elements 1 have a diameter of 60 μm as seen in a plan view. The pitch between each of light-emitting elements 1-1 and 1-2, light-emitting elements 1-2 and 1-3, and light-emitting elements 1-3 and 1-4 in the main scanning direction is set to 21 μm, in accordance with the magnitude of the resolution of the main scanning direction.

The pitch between light-emitting elements 1-1, 1-2 in the sub scanning direction is set to a distance corresponding to an amount of displacement of the circumferential surface of the photoreceptor drum 11, rotating at a constant speed, over a period 8H. The period 8H has a value of eight times a time 1H required for the circumferential surface of the photoreceptor drum 11 to make a 10.6 μm displacement corresponding to the resolution in the sub scanning direction, and corresponds to time Δt described above. The time 1H corresponds to the duration of one main scanning period, described later. The pitch in the sub scanning direction between light-emitting elements 1-2 and 1-3, and between light-emitting elements 1-3 and 1-4, is likewise set to a distance corresponding to the period 8H.

Given light-emitting elements 1-1 through 1-4 forming a single light-emitting element group, 4000 other groups having the same positional relationship (light-emitting elements 1-5 through 1-8, light-emitting elements 1-9 through 1-12, etc.) in the main scanning direction are configured in parallel arrangements. With attention to the first zigzag tier only, light-emitting elements 1*a* are arranged in parallel along the main scanning direction at a resolution of 300 dpi in the main scanning direction. The same applies to the second, third, and fourth zigzag tiers.

The light-emitting unit 100 having light-emitting elements 1*a* through 1*d* is arranged in a region 1*e* on the TFT substrate 71, the region 1*e* having an elongated shape in the main scanning direction. Drive units, each including a drive circuit, an S/H circuit, and so on, are provided to drive the light-emitting elements 1. The drive units distributed among regions 2*a* and 2*b* that are each located at a different side of the region 1*e* in a direction parallel to the sub scanning direction. However, this may be replaced by a configuration in which the drive units are arranged at only one of two areas opposing each other with the light-emitting unit 100 therebetween.

(Relationship Between Light-Emitting Elements, Drive Circuit, S/H Circuit, and Source IC)

Figure 5:
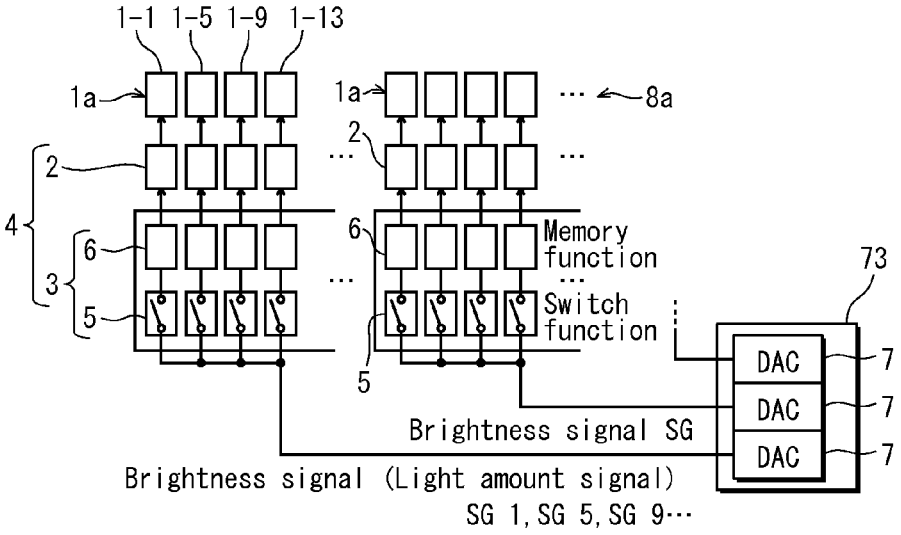
FIG. 5 is a diagram schematically illustrating the relationship between the light-emitting elements, a drive circuit, an S/H (sample/hold) circuit, and a source IC.

FIG. 5 is a diagram schematically illustrating the relationship between light-emitting elements 1*a* of the first zigzag tier, drive circuits 2, S/H (sample/hold) circuits 3, and the source IC 73.

As illustrated, each S/H circuit 3 is formed by a switch element 5 and a holding element (i.e., a condenser or the like) 6 connected in series. Each S/H circuit 3 corresponds to one drive circuit 2, and each drive circuit 2 corresponds to one light-emitting element 1*a*. In some cases, a set of a drive circuit 2, a switching element 5, and a holding element 6 corresponding to one light-emitting element 1 is collectively termed a drive unit 4.

Moreover, the source IC 73 includes a plurality of DACs 7. Each DAC 7 corresponds to a plurality of S/H circuits 3, e.g., one hundred S/H circuits 3. In other words, each DAC 7 corresponds to one hundred light-emitting elements 1. For example, a bottommost one of the DACs 7 sequentially outputs brightness signals SG1, SG5, SG9, SG13, and so on in correspondence with one hundred light-emitting elements corresponding thereto, i.e., light-emitting elements 1-1, 1-5, 1-9, 1-13, and so on.

The following occurs in a situation where the respective switch elements 5 of the one hundred S/H circuits 3 corresponding to the bottommost one of the DACs 7 are all OFF (non-conducting), and brightness signals SG1, SG5, SG9, and so on are output one at a time in chronological order, in accordance with the image data from the DAC 7.

Specifically, once brightness signal SG1 is output from the DAC 7, only the switch element 5 of the S/H element 3 corresponding to light-emitting element 1-1 (on the left-hand edge in FIG. 5) switches from OFF to ON (conducting) in synchronization with the output timing, and brightness signal SG1 is written to the holding element 6 of the S/H circuit 3 (brightness signal sampling). The switch element 5 remains OFF in all other S/H circuits 3, and thus, brightness signal SG1 writes nothing to the other holding elements 6.

Once writing of the brightness signal SG1 to the holding element 6 is complete, the switch element 5 of the S/H circuit 3 corresponding to light-emitting element 1-1 reverts to being OFF. However, the holding element 6 continues to hold the voltage written thereto.

Afterward, upon reaching the timing at which the next brightness signal SG5 is output from the DAC 7, only the switch element 5 of the S/H element 3 corresponding to light-emitting element 1-5 (second from the left-hand edge) switches from OFF to ON in synchronization with the output timing, and brightness signal SG5 is written to the holding element 6. Once writing of the brightness signal SG5 is complete, the switch element 5 reverts to being OFF. However, the holding element 6 continues to hold the voltage written thereto.

The operation of switching of the switch element 5 and writing the brightness signal SG is repeated in chronological order for each S/H circuit 3, at the input timing of each brightness signal SG1, SG3, SG5, and so on. Shift registers 9*a*, 9*b* (see FIG. 7) are used for the switching.

Each drive circuit 2 controls electric current from a power supply (not diagrammed) in accordance with the voltage held by the corresponding holding element 6, and supplies the electric current to the corresponding light-emitting elements 1*a*. Each light-emitting element 1*a* emits light due to this supplied current, in an amount based on the brightness signal SG As such, each DAC 7 is shared by a plurality of light-emitting elements 1*a*, for example by one hundred light-emitting elements 1*a*.

Here, the image data includes data representing a non-exposure region where the toner image is not formed (base portions of the original or the like). The brightness signal SG corresponding to this non-exposure region indicates a zero light amount. For a brightness signal indicating a zero light amount, no electric current is supplied from a drive circuit 2 to a corresponding light-emitting element 1, and the corresponding light-emitting element 1 remains extinguished.

The output timing of the brightness signals SG1, SG5, SG9, and so on from the bottommost DAC 7 is determined in advance so as to be in synchronization with the ON timing of the switch elements 5 of the S/H circuits 3 corresponding to light-emitting elements 1-1, 1-5, 1-9, and so on having a matching number. Thus, writing, holding, and light emission for a brightness signal SG are performed for each of the one hundred light-emitting elements 1-1, 1-5, 1-9, and so on belonging to the first zigzag tier. The same applies to all other DACs 7. The second, third, and fourth zigzag tiers are configured identically to the first zigzag tier, having a plurality of light-emitting elements 1 sharing a single DAC 7.

The photoreceptor drum 11 is exposed to the light emitted by light-emitting elements 1*a* through 1*d* belonging to the light-emitting unit 100. In the following, first a circuit block indicating the relationships between the light-emitting elements 1 and the DACs 7 is explained, and then a circuit diagram of the TFT substrate 71 is explained.

(Circuit Block)

Figure 6:
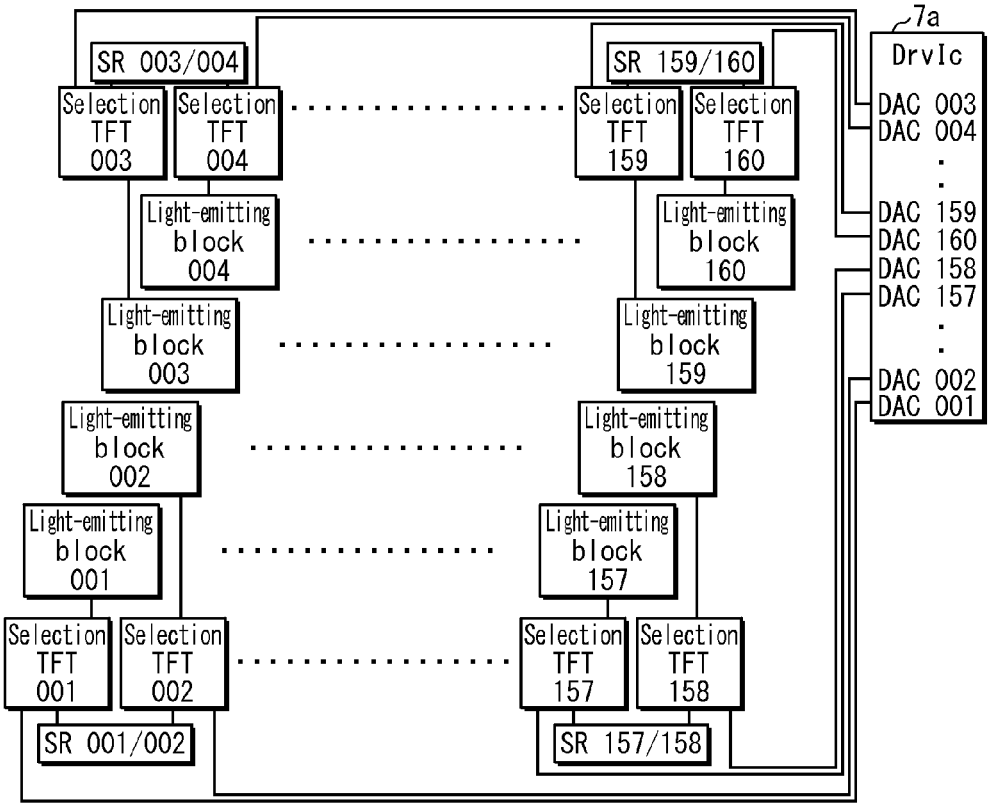
FIG. 6 is a diagram illustrating the relationship between light-emitting blocks and DACs.

FIG. 6 illustrates the relationship between the DACs and light-emitting blocks in each of the first, second, third, and fourth zigzag tiers, in a situation where the light-emitting elements 1 belonging to each tier have been divided into a plurality of light-emitting blocks each including one hundred light-emitting elements 1 aligned in the main scanning direction. The light-emitting blocks are numbered 001 through 160, for a total of 160 light-emitting blocks. Each light-emitting block includes one hundred light-emitting elements 1.

For example, light-emitting block 001 includes one hundred light-emitting elements 1-1, 1-5, 1-9, 1-13 . . . 1-397 belonging to the first zigzag tier. Here, selection TFT 001 corresponding to light-emitting block 001 includes one hundred switch elements 5, in correspondence with the one hundred light-emitting elements 1*a* belonging to light-emitting block 001. Also, DAC 001 is provided to correspond one-to-one with selection TFT 001. Here, DAC 001 is identical to the above-described DAC 7. In FIG. 6, reference signs 001, 002 . . . 160 are assigned to each of the plurality of DACs 7 in order to distinguish them.

Specifically, the DACs corresponding to the first zigzag tier are numbered 4×n−3 (where n is an integer from 1 to 40), the DACs corresponding to the second zigzag tier are numbered 4×n−2, the DACs corresponding to the third zigzag tier are numbered 4×n−1, and the DACs corresponding to the fourth zigzag tier are numbered 4×n. Each DAC 001 through 160 is formed from a DrvIC (Driver IC) 7*a*. The DrvIC 7*a* is embedded within the source IC 73.

A single DAC outputting the brightness signal is provided in correspondence with a single light-emitting block composed of a plurality of light-emitting elements aligned in a row. In other words, the DACs are provided in a quantity matching the quantity of light-emitting blocks. Thus, there is a one-to-one correspondence between the DACs and the light-emitting blocks.

Light-emitting block 002 includes one hundred light-emitting elements 1-2, 1-6, 1-10, 1-14 . . . 1-398 belonging to the second zigzag tier. Here, selection TFT 002 corresponding to light-emitting block 002 includes one hundred switch elements 5, in correspondence with the one hundred switch elements 1*b* belonging to light-emitting block 002. DAC 002 is provided to correspond one-to-one with selection TFT 002.

One shift register (hereinafter also SR) is shared by selection TFT 001 and selection TFT 002. That is, SR 001/002 corresponds to selection TFT 001 and to selection TFT 002.

The above-described relationship between light-emitting blocks 001, 002, selection TFTs 001, 002, and SR 001/002 likewise applies to light-emitting blocks 003 through 160, selection TFTs 003 through 160, and SR 003/004 through SR 159/160.

(TFT Substrate Circuit Diagram)

Figure 7:
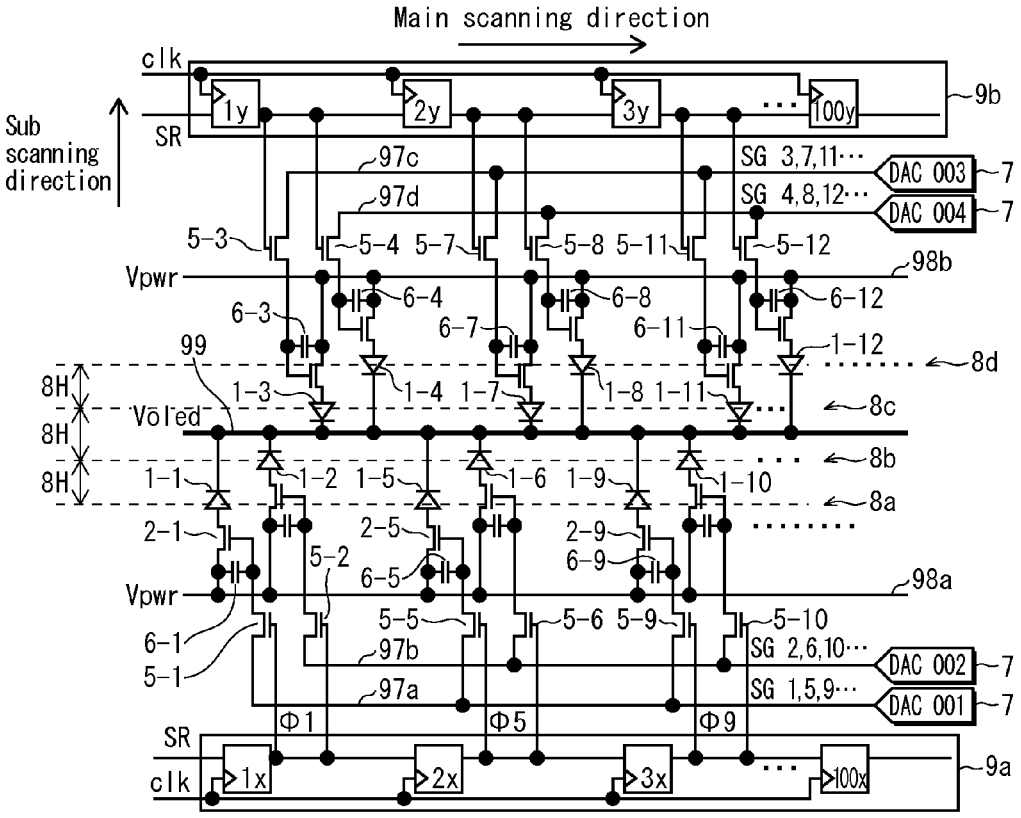
FIG. 7 is a diagram illustrating a portion of a circuit of the light-emitting blocks illustrated in FIG. 6.

FIG. 7 is a diagram illustrating a portion of a circuit for light-emitting blocks 001 through 004 on the TFT substrate 71 illustrated in FIG. 6, with reference signs 1 through 12 added in order to distinguish among the light-emitting elements 1. Also, reference signs 1, 5, 9, and so on are added to the drive circuits 2, the switch elements 5, and the holding elements 6 in order to distinguish the components corresponding to each of the light-emitting elements 1. Here, each drive circuit 2 is identical in terms of shape, size, materials and so on, therefore having identical properties. The same also applies to the switch elements 5 and the holding elements 6.

As illustrated in FIG. 7, a cathode terminal of light-emitting element 1-1 is connected to a Voled power supply line 99, and an anode terminal of light-emitting element 1-1 is connected to a drain terminal of drive circuit 2-1, which is an FET (field-effect transistor). A source terminal of drive circuit 2-1 is connected to a Vpwr power supply line 98*a*, and a gate terminal of drive circuit 2-1 is connected to a drain terminal of switch element 5-1, which is an FET. The source terminal and gate terminal of drive circuit 2-1 are connected via holding element 6-1. Drive circuit 2-1 has a p-channel, and may also have an n-channel.

The source terminal of switch element 5-1 is connected to DAC 001, and the gate terminal of switch element 5-1 is connected to output stage 1*x* of a first stage of shift register 9*a*.

Figure 8:
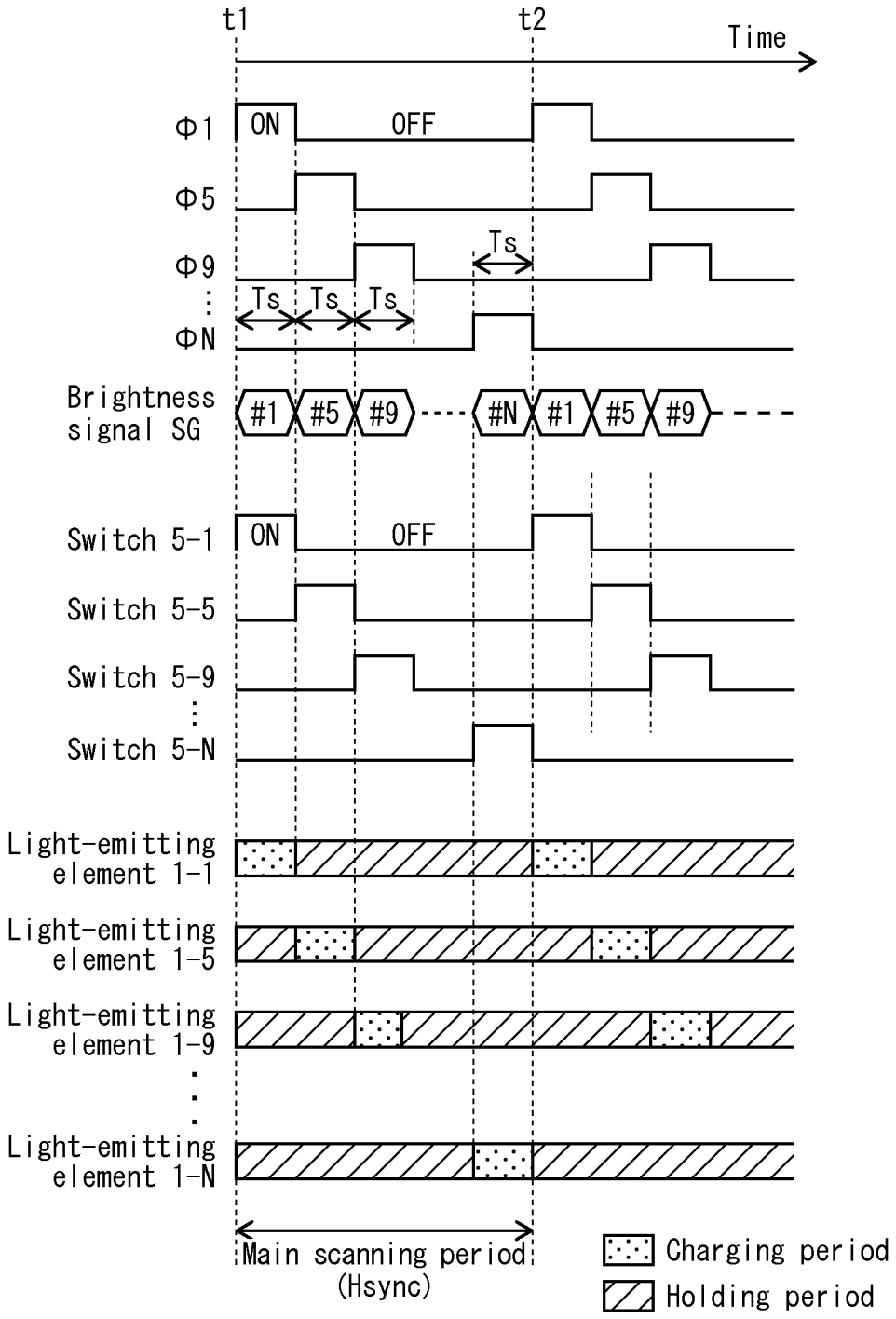
FIG. 8 is a diagram providing a timing chart of light emission control of the light-emitting elements belonging to a first zigzag tier.

Shift register 9*a* includes output stages 1*x* through 100*x*, numbered first through hundredth, incorporated in a single IC. Shift register 9*a* sequentially outputs pulse signals ϕ1, ϕ5, ϕ9, and so on indicating high level, in order from output stage 1*x* of the first stage to output stage 100*x* of the hundredth stage in accordance with input of a clk signal having a fixed cycle. The output timing of the pulse signals ϕ1, ϕ5, ϕ9, and so on is offset by a fixed interval Ts (FIG. 8). The shift register 9*a* corresponds to SR 001/002 illustrated in FIG. 6.

The circuit configuration of the other light-emitting elements 1-5, 1-9, . . . 1-397 and the drive circuits 2, the switch elements 5, and the holding elements 6 respectively corresponding thereto are basically similar to the circuit configuration of light-emitting element 1-1, drive circuit 2-1, switch element 5-1, and holding element 6-1. However, there are points of difference in that the gate terminals of switch elements 5-5, 5-9, and so on are connected to output stage 2*x* of the second stage, to output stage 3*x* of the third stage, and so on, within shift register 9*a*.

DAC 001 outputs brightness signals SG1, SG5, SG9, and so on to a single signal line 97*a* in correspondence with light-emitting elements 1-1, 1-5, 1-9, . . . 1-397 belonging to the first zigzag tier (light-emitting element array 8*a*), in numerical order with the fixed interval Ts (FIG. 8). The signal line 97*a* extends out from the DAC 001. The timing is set in advance such that the output timing of the respective brightness signals SG1, SG5, SG9, and so on and the timing at which the respective output signals ϕ1, ϕ5, ϕ9, and so on of the output stages 1*x*, 2*x*, 3*x*, and so on change to high level are synchronized for matching numbers.

As a result, each switch element 5 respectively corresponding to the light-emitting elements 1-1, 1-5, 1-9, and so on, is switched ON only when the corresponding output signal ϕ1, ϕ5, ϕ9, and so on change to high level, that is, only when the high level signal has been input. As such, each of the output signals ϕ1, ϕ5, and so on, output in order, is termed an instruction signal for switching a connection status of the corresponding one of the switch elements 5-1, 5-5, and so on, in order.

For example, once output signal ϕ1 changes to high level and switch element 5-1 is switched ON, the voltage of brightness signal SG1, input in synchronization with the switching ON, is written to holding element 6-1 (electrical charging). Then, once output signal ϕ1 changes from high level to low level and switch element 5-1 is switched OFF, the writing of brightness signal SG1 corresponding to light-emitting element 1-1 ends, and the voltage of brightness signal SG1 is held in holding element 6-1.

In the present embodiment, an OLED is used for the each of the light-emitting elements 1, and the drive circuits 2 and the switch elements 5 are each a TFT (low-temperature polycrystalline silicon (LTPS) or amorphous Si). The TFT is relatively slow, which is a point of difference from the GaAs or mono-crystalline Si device that drives a light-emitting diode (LED). As such, a single shift register 9*a* is not configured to correspond to a large number of switch elements 5, e.g., a several hundred switch elements 5. Rather, a single shift register 9*a* is configured to correspond to one hundred switch elements 5, which correspond to a single one of the DACs 7.

In other words, the switch elements 5 are divided into groups of one hundred, and a single shift register 9*a* is provided for each group. This serves to further improve the synchronization between the output timing of the brightness signals SG1, SG5, SG9, and so on output from DAC 001 and the ON and OFF switching of switch elements 5-1, 5-5, 5-9, and so on while also reducing the processing load.

Drive circuit 2-1 is a voltage drive circuit controlling current from the power supply line Vpwr 98*a* in accordance with the voltage between the source terminal and the gate terminal, in other words, the voltage held by holding element 6-1, and supplying the current to light-emitting element 1-1. The drive current subjected to this control flows in a Voled power supply line 99 via light-emitting element 1-1. Thus, light-emitting element 1-1 is caused to emit light in an amount corresponding to the voltage value of brightness signal SG1.

Once output signal ϕ1 changes to low level and output signal ϕ5 subsequently changes to high level, switch element 5-5 is switched ON, and the voltage of brightness signal SG5, input in synchronization with the switching ON, is written to holding element 6-5. Then, once output signal ϕ5 changes to low level and switch element 5-5 is switched OFF, the writing of brightness signal SG5 corresponding to light-emitting element 1-5 ends, and the brightness signal SG5 is held in holding element 6-5.

For output signal ϕ9 through output signal ϕ397 (not illustrated), the switching to high level is respectively performed sequentially with a fixed interval Ts, similarly to the situations described above, and brightness signals SG9 through SG397 are respectively written to holding elements 6-9 through 6-397.

The writing of brightness signals SG1 through SG397 is executed over one main scanning period. Once the next main scanning period begins, the writing operation is executed sequentially to replace the brightness signals SG1 through SG397 written during the one main scanning period with new brightness signals SG1 through SG397 based on the image from the next main scanning line. This writing operation is repeated for a plurality of main scanning periods, until the writing of the final main scanning line of one page is completed.

FIG. 8 is a timing chart indicating the light emission control of light-emitting elements 1-1 through 1-397 belonging to the first zigzag tier, and illustrates a light emission control method termed rolling drive. In FIG. 8, light-emitting element 1-397 is labeled 1-N.

As illustrated, brightness signal SG1 is output in synchronicity with a period in which signal ϕ1 from shift register 9*a* is at high level. Thus, only switch element 5-1 is switched ON and brightness signal SG1 is written to holding element 6-1, corresponding to light-emitting element 1-1. The writing period of brightness signal SG1 is a sampling period (charging period) Ts corresponding to light-emitting element 1-1.

Once the output of brightness signal SG1 is complete (i.e., signal ϕ1 switches from high to low level), switch element 5-1 reverts to being OFF. Subsequently, brightness signal SG5 is output in synchronicity with a period in which signal ϕ5 from shift register 9*a* is at high level. Thus, only switch element 5-5 is switched ON and brightness signal SG5 is written to holding element 6-5, corresponding to light-emitting element 1-5. The writing period of brightness signal SG2 is the sampling period Ts corresponding to light-emitting element 1-5.

Afterward, the writing of brightness signals SG9 through SGN, corresponding to respective holding elements 6-9 through 6-N of light-emitting elements 1-9 through 1-N, is performed in sequence with a chronological offset. For each light-emitting element 1, a period excluding the sampling period (charging) Ts is a holding period. Each holding period typically has a length on the order of one hundred times the sampling period Ts, for example. Electric current corresponding to the voltage of the respective brightness signal SG1, SG5, SG9, . . . SGN written during the sampling period immediately preceding the holding period is supplied to each light-emitting element 1-1, 1-5, 1-9, . . . 1-N.

A period from the start t1 of the sampling period Ts corresponding to light-emitting element 1-1 to the end t2 of the sampling period Ts corresponding to light-emitting element 1-N is one main scanning period (Hsync). Each main scanning period has a duration corresponding to the time needed to form a latent static image of one line in the main scanning direction on the photoreceptor drum 11. The start of one main scanning period is defined by the timing of a level change in a main scanning signal, whose level changes at predetermined intervals.

Once one main scanning period (t1 to t2) ends, transfer to the next main scanning period (as of t2) is performed.

Returning to FIG. 7, the circuit configuration of the drive circuit 2, the switch element 5, and the holding element 6 corresponding to each light-emitting element 1-2, 1-6, 1-10, . . . 1-398 of the second zigzag tier (i.e., light-emitting element array 8*b*) is also basically similar to the circuit configuration used for light-emitting elements 1-1, 1-5, 1-9, and so on of the first zigzag tier. However, there is a point of difference in that the respective source terminals of the switch elements 5-2, 5-6, 5-10, and so on are connected to DAC 002.

DAC 002 outputs brightness signals SG2, SG6, SG10, . . . SG398 to signal line 97*b* in correspondence with light-emitting elements 1-2, 1-6, 1-10, . . . 1-398 belonging to the second zigzag tier in chronological order. The signal line 97*b* extends out from the DAC 002. The output start timing of the brightness signal SG2 is set in advance, to a time delayed by predetermined interval 8H relative to the output start timing of brightness signal SG1 (time t11 to time t21 in FIG. 11).

In addition, the respective gate terminals of switch elements 5-2, 5-6, 5-10, and so on are connected to output stages 1*x*, 2*x*, 3*x*, and so on of shift register 9*a*. As such, output stage 1*x* simultaneously outputs signal ϕ1 to both the gate terminal of switch element 5-1 and the gate terminal of switch element 5-2. The signal ϕ1 output from one output stage 1*x* is input to switch element 5-1 and is also input to switch element 5-2, in parallel. This means that a single output stage 1$x$ is shared by two switch elements 5-1, 5-2.

As described above, the timing at which signal ϕ1 changes to high level and the output timing of brightness signal SG1 from DAC 001 corresponding to the first zigzag tier are synchronized. Thus, the output timing of brightness signal SG2 from DAC 002 corresponding to the second zigzag tier is also set in advance such that the output timing is in synchronization with the timing at which signal ϕ1 changes to high level.

Specifically, the output timing of brightness signal SG2 is delayed by an integer multiple of time 1H, in this case time 8H, relative to the output timing of brightness signal SG1. One main scanning line is written during each time 1H. As such, the delay time 8H from the writing start time of the initial (first) main scanning line corresponds to the writing start timing of the eighth main scanning line.

Accordingly, the timing is set such that brightness signal SG1 for the eighth main scanning line is output from DAC 001 at the delay time 8H relative to the output timing of brightness signal SG1 for the first main scanning period, and such that brightness signal SG2 for the first main scanning line is simultaneously output from DAC 002.

The same applies to output stage 2$x$, where a single output stage 2$x$ is shared by switch elements 5-5, 5-6. Accordingly, the output timing of brightness signal SG6 from DAC 002 is set in advance so as to be in synchronization with the timing at which signal ϕ5 changes to high level. That is, the output timing of brightness signal SG6 is delayed by time 8H relative to the output timing of brightness signal SG5. Brightness signals SG5 and SG6 are thus in a similar relationship to brightness signals SG1 and SG2. The same applies to output stage 3$x$ and so on.

Two of the switch elements are configured to share a single output stage. As such, the total number of output stages provided in one shift register is halved in comparison to a configuration in which a single output stage corresponds to a single switch element, which produces a cost reduction.

The timing chart for light emission control pertaining to light-emitting elements 1-2, 1-6, 1-10, and so on belonging to the second zigzag tier is basically identical to the timing chart for light emission control of the first zigzag tier illustrated in FIG. 8. However, there is a point of difference in that, as described above, the output start timing of brightness signal SG2 for the second zigzag tier is delayed by time 8H relative to the output start timing of brightness signal SG1 for the first zigzag tier.

Light-emitting element array 8$c$, made up of light-emitting elements 1-3, 1-7, 1-11, . . . 1-399 belonging to the third zigzag tier, and light-emitting element array 8$d$, made up of light-emitting elements 1-4, 1-8, 1-12, . . . 1-400 belonging to the fourth zigzag tier are arranged at an opposite side of the Voled power supply line 99 relative to light-emitting element arrays 8$a$, 8$b$, in the sub scanning direction.

The respective circuit configurations of the third zigzag tier and the fourth zigzag tier are basically identical to the circuit configurations of the first zigzag tier and the second zigzag tier. Shift register 9$b$ is provided for the third zigzag tier and the fourth zigzag tier. Here, shift register 9$b$ corresponds to SR 003/004 illustrated in FIG. 6.

The respective gate terminals of switch elements 5-3, 5-7, 5-11, and so on corresponding to light-emitting elements 1-3, 1-7, 1-11, and so on belonging to the third zigzag tier are connected to output stage 1$y$ of the first stage, output stage 2$y$ of the second stage, output stage 3$y$ of the third stage, and so on, in shift register 9$b$. Also, the respective gate terminals of switch elements 5-4, 5-8, 5-12, and so on corresponding to light-emitting elements 1-4, 1-8, 1-12, and so on belonging to the fourth zigzag tier are connected to output stages 1$y$, 2$y$, 3$y$, and so on, in shift register 9$b$.

A single output stage 1$y$ is shared by two switch elements 5-3, 5-4. Likewise, another single output stage 2$y$ is shared by two switch elements 5-7, 5-8. The same applies to output stage 3$y$ and so on.

In addition, there is a point of difference in that the respective source terminals of switch elements 5-3, 5-7, 5-11, and so on corresponding to light-emitting elements 1-3, 1-7, 1-11, and so on are connected to DAC 003, and the respective source terminals of switch elements 5-4, 5-8, 5-12, and so on corresponding to light-emitting elements 1-4, 1-8, 1-12, and so on are connected to DAC 004.

DAC 003 outputs brightness signals SG3, SG7, SG11, and so on, corresponding to light-emitting elements 1-3, 1-7, 1-11, . . . 1-399 belonging to the third zigzag tier to signal line 97$c$ in numerical order at the fixed interval Ts. Likewise, DAC 004 outputs brightness signals SG4, SG8, SG12, and so on, corresponding to light-emitting elements 1-4, 1-8, 1-12, . . . 1-400 belonging to the fourth zigzag tier to signal line 97$d$ in numerical order at the fixed interval Ts. As such, the DAC that outputs the brightness signals supplied to the respective drive units 4 of each of the light-emitting elements 1 belonging to one of the light-emitting element arrays differs from the DACs that output the brightness signals supplied to the respective drive units 4 of each of the light-emitting elements 1 belonging to the other ones of the light-emitting element arrays.

Output stages 1$y$, 2$y$, and so on of shift register 9$b$ output the signals ϕ indicating high level in order, at the fixed interval Ts, in synchronicity with the output timing of brightness signals SG3, SG7, SG11, and so on, similarly to output stages 1$x$, 2$x$, and so on of shift register 9$a$.

As a result, brightness signals SG3, SG7, SG11, and so on are written during the sampling period to holding elements 6-3, 6-7, 6-11, and so on corresponding to light-emitting elements 1-3, 1-7, 1-11, and so on having matching numbers. During the holding period, electric current corresponding to the voltage written by each brightness signal SG is supplied from the Vpwr power supply line 98$b$ to light-emitting elements 1-3, 1-7, 1-11, and so on. These operations are executed every time the sampling period and the holding period are repeated in alternation.

Similarly, brightness signals SG4, SG8, SG12, and so on are written during the sampling period to holding elements 6-4, 6-8, 6-12, and so on corresponding to light-emitting elements 1-4, 1-8, 1-12, and so on, having matching numbers. During the holding period, electric current corresponding to the voltage written by each brightness signal SG is supplied from the Vpwr power supply line 98$b$ to the light-emitting elements 1-4, 1-8, 1-12, and so on. These operations are executed every time the sampling period and the holding period are repeated in alternation.

Figure 11:
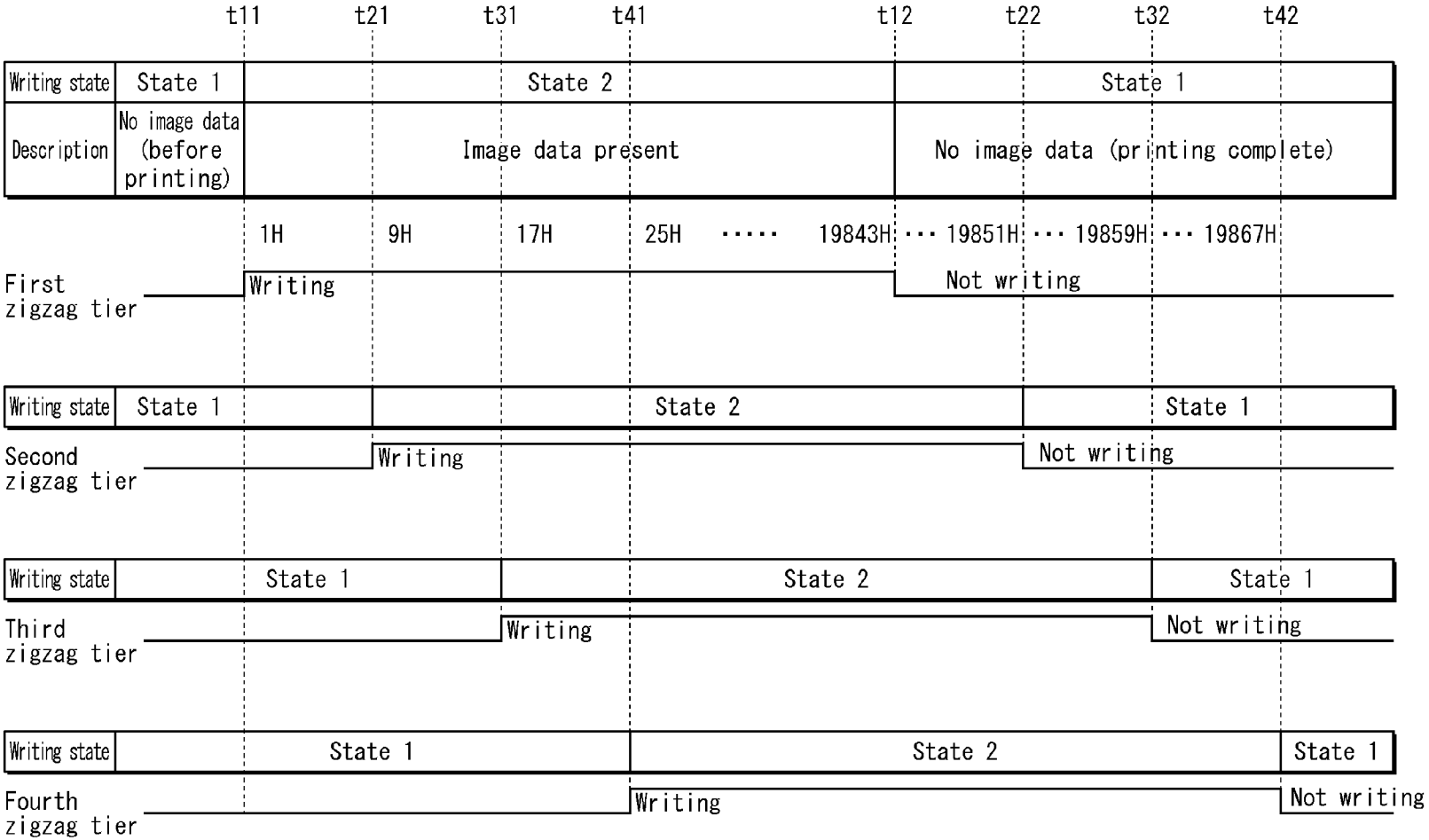
FIG. 11 is a timing chart explaining a writing state of an optical beam per page in each tier among first through fourth zigzag tiers.

The output start timing of brightness signals SG3, SG4 is set in advance, to a time delayed by predetermined intervals 16H, 24H relative to the output start timing of brightness signal SG1 (t11), as illustrated in FIG. 11. That is, the output start timing of brightness signal SG3 is set to time t31, and the output start timing of brightness signal SG4 is set to time t41.

For example, brightness signal SG3 for the first main scanning line is output from DAC 003 at delay time 16H relative to the output timing of brightness signal SG1 for the first main scanning line. Also, brightness signal SG3 for the eighth main scanning line is output from DAC 003 at the delay time 24H relative to the output timing of brightness signal SG1 for the first main scanning line, and brightness signal SG4 for the first main scanning line is simultaneously output from DAC 004. The same applies to other brightness signals SG7 and SG8, SG11 and SG12, and so on, similarly to brightness signals SG3 and SG4.

The above-described configuration enables the circuit scale of the DACs to be miniaturized. The reasoning is explained below.

(Circuit Scale Miniaturization Reasoning)

FIG. 9 is a schematic diagram indicating a configuration example of source image data of the original image. The diagram indicates the allocation of the source image data to light-emitting elements 1-1, 1-2, 1-3, and so on, in tabular form. Also, this diagram gives an example in which the light-emitting elements 1 number 14032 in total.

The Main Scanning Direction Arrangement Position of Light-emitting Elements line at the top of the diagram indicates the alignment order of light-emitting elements 1-1, 1-2, 1-3, and so on in the main scanning direction. Position 1 corresponds to light-emitting element 1-1, position 2 corresponds to light-emitting element 1-2, and position 3 corresponds to light-emitting element 1-3. In the diagram, only numbers 1 through 9 are given for the positions, and the light-emitting elements are omitted from positions 9 through 14032.

The vertical column on the left-hand edge of the diagram, reading 1H, 2H, 3H, . . . 19843H indicates the numbers assigned to the main scanning lines, in order, from a leading edge 1H to a trailing edge 19843H of the original image, when the original image has been equally divided into partial images as 19843 main scanning lines in the sub scanning direction. The ordering is equivalent to the writing order used when the original image is written in main scanning line units. The numbers of the main scanning lines represent the number of main scanning periods, each having the time 1H.

The numerical values in the diagram, such as 50, 45, and so on, indicate the respective brightness values corresponding to light-emitting elements 1-1, 1-2, 1-3, and so on, in accordance with the source image data. For example, the numerical values for light-emitting elements 1-1, 1-2, 1-3, and 1-4 corresponding to main scanning line 1H are 50, 45, 60, and 65, respectively.

FIG. 10 is a schematic diagram illustrating a configuration example of print image data, in which the source image data illustrated in FIG. 9 has been separately allocated in light-emitting element array units to each of the first, second, third, and fourth zigzag tiers.

As illustrated in FIG. 10, image data 81 for the first zigzag tier is formed by extracting only brightness values of light-emitting elements 1-1, 1-5, 1-9, and so on belonging to the first zigzag tier from the source image data illustrated in FIG. 9. The same applies to image data 82, 83, and 84 for the second, third, and fourth zigzag tiers, respectively.

The above-described DACs 7 output the brightness signals SG for each main scanning line, based on the corresponding data among the image data 81, 82, 83, and 84 for the first, second, third, and fourth zigzag tiers, respectively.

For example, when writing the image of the first main scanning line 1H, DAC 001 reads brightness values 50, 51, 52, and so on of main scanning line 1H corresponding to light-emitting elements 1-1, 1-5, 1-9, and so on, from image data 81 for the first zigzag tier, and then sequentially outputs brightness signals SG1, SG5, SG9, and so on indicating the brightness values that have been read.

When writing the image of the second main scanning line 2H once the writing of the first main scanning line 1H is complete, DAC 001 reads brightness values 55, 56, 57, and so on of main scanning line 2H and then sequentially outputs brightness signals SG1, SG5, SG9, and so on indicating the brightness values that have been read. The DAC 001 repeats the execution of these operations for each main scanning line, until main scanning line 19843H.

The remaining DACs 005, 009, . . . 157 corresponding to the first zigzag tier also output the brightness signal in main scanning line unit based on the image data 81 for the first zigzag tier, similarly to DAC 001. In addition, the DACs 7 corresponding to each of the second, third, and fourth zigzag tiers also output the brightness signals SG in main scanning line units in accordance with the corresponding image data 82, 83, 84, identically to the first zigzag tier.

The DACs 001, 002, and so on execute the output of the brightness signals SG by reading the corresponding image data (one of 81, 82, 83, and 84) from the source image data. However, for example, a generation unit (not diagrammed) generating the image data 81, 82, 83, 84 from the source image data may be provided, and the image data 81, 82, 83, 84 so generated may be supplied to the DACs 7.

FIG. 11 is a timing chart for explaining a writing state of the optical beam L per page in each tier among the first, second, third, and fourth zigzag tiers.

The writing state is one of State 1 and State 2, as indicated in FIG. 11. With attention to the first zigzag tier, the writing state transitions in the order State 1, State 2, State 1.

Here, State 1 is a state in which no print image data exists. Specifically, State 1 indicates a state in which a signal for forcibly extinguishing (hereinafter termed an extinguish signal) all light-emitting elements 1-1, 1-5, 1-9, and so on belonging to the first zigzag tier is output from all of the DACs 001, 005, and so on corresponding to the first zigzag tier, instead of the brightness signals SG. As such, State 1 may also be termed a non-writing state.

Conversely, State 2 is a state in which print image data is present. Specifically, State 2 indicates a state in which the writing operation of the main scanning lines 1H through 19843H based on the print image data is being executed. In FIG. 11, during an interval from time t11 to time t12, brightness signals SG are sequentially output to each DAC 001, 005, and so on corresponding to the first zigzag tier in order to cause the light-emitting elements corresponding to the DACs to emit light at the brightness in accordance with the image data 81 for the first zigzag tier. As such, light emission control is performed individually for all light-emitting elements 1-1, 1-5, 1-9, and so on belonging to the first zigzag tier. A preceding interval with respect to time t11 is before print start, and an interval as of time t11 until time t12 is a print execution interval.

Once the writing of one page by the light-emitting elements 1 of the first zigzag tier is complete (at time t12), State 1 resumes and the output of the extinguish signal by the DACs 001, 005, and so on is resumed.

Next, with attention to the second zigzag tier, the writing state transitions in the sequence State 1, State 2, State 1. This point is similar to the first zigzag tier. However, for the second zigzag tier, in comparison to the first zigzag tier, the start timing of State 2 is delayed by time 8H relative to the start timing of State 2 for the first zigzag tier (time t11), and is thus time t21.

Due to this delay by time 8H, the image written by the light-emitting elements 1 belonging to the first zigzag tier and the image written by the light-emitting elements 1 belonging to the second zigzag tier are formed on the same main scanning line on the photoreceptor drum 11.

While the second zigzag tier is in State 1, that is, before print start, and during the interval from writing start for the first zigzag tier (time t11) to time t21 at a predetermined delay time 8H, the extinguish signal for forcibly extinguishing all light-emitting elements 1-2, 1-6, 1-10, and so on belonging to the second zigzag tier is output from all DACs 002, 006, and so on corresponding to the second zigzag tier.

Then, upon transition to State 2, that is, upon reaching time t21, output begins of the brightness signals SG based on image data 82 for the second zigzag tier from all DACs 002, 006, and so on corresponding to the second zigzag tier.

State 2 continues until time 22 (corresponding to time 8H elapsed since time t12). While in State 2, the operation of writing the main scanning lines 1H through 19843H based on image data 82 is executed. Reversion to State 1 occurs upon reaching time t22.

For the third zigzag tier and the fourth zigzag tier, the writing state also transitions in the sequence State 1, State 2, State 1, similarly to the situation described above for the first zigzag tier and the second zigzag tier. Then, for the third and fourth zigzag tiers, in comparison to the first zigzag tier, the start timing of State 2 is delayed by time 16H and time 24H, respectively, relative to the start timing of State 2 for the first zigzag tier (time t11), and is thus time t31 and time t41, respectively.

As described above, the amount of offset between arrangement positions of neighboring tiers, among the first, second, third, and fourth zigzag tiers, in the sub scanning direction corresponds to an interval of time 8H. As such, relative to the standard of the first zigzag tier, the delay interval for the start timing of State 2 for the second zigzag tier is 8H, the delay interval for the start timing of State 2 for the third zigzag tier is 16H, and the delay interval for the start timing of State 2 for the fourth zigzag tier is 24H.

State 2 of the third zigzag tier continues until time t32 (corresponding to time 16H elapsing since time t12). While in State 2, the operation of writing the main scanning lines 1H through 19843H based on image data 83 is executed. Reversion to State 1 occurs upon reaching time t32.

Similarly, State 2 of the fourth zigzag tier continues until time t42 (corresponding to time 24H elapsing since time t12). While in State 2, the operation of writing the main scanning lines 1H through 19843H based on image data 84 is executed. Reversion to State 1 occurs upon reaching time t42.

A delay in lighting start timing for each of the second, third, and fourth zigzag tiers, relative to the first zigzag tier, is executed by providing the DACs corresponding to the second, third, and fourth zigzag circuits with a delay circuit delaying the output start timing of the brightness signals SG by a predetermined time (8H, 16H, 24H).

In other words, given an upstream tier (i.e., an upstream element row) and a downstream tier (i.e., a downstream element row) neighboring each other in the sub scanning direction, the DACs corresponding to the downstream tier are configured to output the brightness signals for the light-emitting elements belonging to the downstream tier with a delay of a time (8H) corresponding to the distance in the sub scanning direction between the upstream tier and the downstream tier, relative to the DACs corresponding to the upstream tier.

Accordingly, images forming one line along the main scanning direction in the original image are reproduced to form one scan line on the photoreceptor drum 11, which is rotating. Thus, a latent static image corresponding to one line along the main scanning direction is formed on the photoreceptor drum 11 during each main scanning period. Consequently, latent static images corresponding to an image of one page are formed in the rotational direction (i.e., the sub scanning direction) of the photoreceptor drum 11.

As such, light emission by the light-emitting elements 1 is controlled for each of the first, second, third, and fourth zigzag tiers. Each tier only has State 1 and State 2 as writing states. That is, for each of the first, second, third, and fourth zigzag tiers, switching management may be performed in two stages, between State 1 and State 2, one at a time for each corresponding DAC 7.

In contrast, in a method in which a single DAC performs light emission control of the light-emitting elements 1-1, 1-2, 1-3, and so on in alignment order of a zigzag arrangement, that is, in which light emission control is performed one by one in numerical order (comparative example corresponding to conventional technology), rather than controlling the first, second, third, and fourth zigzag tiers one tier at a time, the single DAC must perform switching management of the states in eight stages, which complicates the circuit scale. This is explained with reference to FIG. 12 and FIG. 13.

FIG. 12 is a schematic diagram illustrating a configuration example of print image data in a situation where the comparative example method is used. In this example, a total of 14032 of the light-emitting elements 1 are provided, similarly to FIG. 9. Also, given that a single DAC is associated with one hundred light-emitting elements, a plurality of DACs therefore each control a separate set of one hundred light-emitting elements.

As illustrated in FIG. 12, for example, an interval from main scanning lines 1H to 8H with respect to light-emitting element 1-2 of the second zigzag tier, an interval from main scanning line 1H to 16H with respect to light-emitting element 1-3 of the third zigzag tier, an interval from main scanning line 1H to 24H with respect to light-emitting element 1-4 of the fourth zigzag tier, and so on are indicated by dot filling. These dot filled regions represent regions where the image data does not exist. The same applies to light-emitting element 1-5 and so on.

Output of the extinguish signal is required for the regions where the image data does not exist, as described above. Thus, the respective writing start timing of the second, third, and fourth zigzag tiers is delayed by time 8H, time 16H, and time 24H relative to the writing start timing of the first zigzag tier, i.e., by a period corresponding to the output period of the extinguish signal.

This is identical to the embodiment illustrated in FIG. 11. However, in the comparative example, a single DAC must switch between outputting the extinguish signal and brightness signal for each of light-emitting element 1-1, 1-2, . . . 100.

For example, during the interval from main scanning line 1H to 8H, the brightness signals SG are output to the light-emitting elements numbered 1, 5, 9, and so on belonging to the first zigzag tier in main scanning line units, while the extinguish signal is output individually to the light-emitting elements numbered 2 to 4, 6 to 8, and so on belonging to the second, third, and fourth zigzag tiers. This state is termed State 2 (corresponding to state A described above).

During the interval from main scanning line 9H to 16H, the brightness signals SG are output to the light-emitting elements numbered 1, 2, 5, 6, 9, 10, and so on belonging to the first zigzag tier and the second zigzag tier in main scanning line units, while the extinguish signal is output individually to the light-emitting elements numbered 3, 4, 7, 8, and so on belonging to the third zigzag tier and the fourth zigzag tier. This state is termed State 3 (corresponding to state B described above).

Then, during the interval from main scanning line 17H to 24H, the brightness signals SG are output to the light-emitting elements numbered 1 to 3, 5 to 7, and so on belonging to the first, second, and third zigzag tiers in main scanning line units, while the extinguish signal is output individually to the light-emitting elements numbered 4, 8, and so on belonging to the fourth zigzag tier. This state is termed State 4 (corresponding to state C described above).

During the interval from main scanning line 25H to 19843H, the brightness signals SG are output to all of the light-emitting elements numbered 1 through 19843 belonging to the first, second, third, and fourth zigzag tiers in main scanning line units. This state is termed State 5 (corresponding to state D described above).

During the interval from main scanning line 19844H to 19851H, the extinguish signal is output to the light-emitting elements numbered 1, 5, and so on belonging to the first zigzag tier in main scanning line units, while the brightness signals SG are output individually to the light-emitting elements numbered 2 to 4, 6 to 8, and so on belonging to the second, third, and fourth zigzag tiers. This state is termed State 6.

During the interval from main scanning line 19852H to 19859H, the extinguish signal is output to the light-emitting elements numbered 1, 2, 5, 6, 9, 10, and so on belonging to the first zigzag tier and the second zigzag tier in main scanning line units, while the brightness signals SG are output individually to the light-emitting elements numbered 3, 4, 7, 8, and so on belonging to the third zigzag tier and the fourth zigzag tier. This state is termed State 7.

Then, during the interval from main scanning line 19860H to 19867H, the extinguish signal is output to the light-emitting elements numbered 1 to 3, 5 to 7, and so on belonging to the first, second, and third zigzag tiers in main scanning line units, while the brightness signals SG are output individually to the light-emitting elements numbered 4, 8, and so on belonging to the fourth zigzag tier. This state is termed State 8.

FIG. 13 is a table indicating the content of each state, from State 1 to State 8, in tabular format. A single DAC must perform switching management on the one hundred light-emitting elements, in main scanning line units, from State 1 through State 8.

From State 2 to State 4, the quantity of light-emitting elements to be extinguished decreases in this order. Meanwhile, from State 6 to State 8, the quantity of light-emitting elements to be extinguished increases in this order. As such, the quantity of light-emitting elements to be forcibly extinguished varies depends upon the current state. Circuits for managing both the operation of switching between being extinguished and emitting light for all light-emitting elements, and the operation of remaining extinguished in the current state until the switch to the next state, must thus be embedded into a single DAC.

As described above in the section titled Problems to be Solved by the Invention, this circuit configuration requires a circuit scale on the order of 80 000 gates, for example, based on the inventors' heuristics. A circuit scale of 80 000 gates requires an area roughly on the order of 2 $mm^2$, with some variation depending on the semiconductor process method.

The source IC 73 embedded in the OLED panel 61, as used in the present embodiment, is currently under demand for constraint to a size roughly on the order of 6 $mm^2$ to 8 $mm^2$, given cost concerns. As such, having the DrvIC 7*a* alone take up a region on the order of 2 $mm^2$ in size makes realization of the target size unlikely and represents an increase in costs.

In contrast, according to the configuration of the present embodiment, as described above, a single DAC 7 simply switches between State 1 and State 2. Having only ¼ as many states as the comparative example enables the overall circuit scale to be reduced to a scale on the order of 20 000 gates.

A circuit scale of 20 000 gates empirically takes up an area on the order of roughly 0.5 $mm^2$. As such, this enables a large reduction in size in comparison to the area on the order of 2 $mm^2$ of the comparative example, which achieves the target size and also enables a great reduction in costs.

In the configuration of the present embodiment, as described above, the light-emitting unit 100 includes a plurality of light-emitting element arrays (e.g., four light-emitting element arrays) arranged along the sub scanning direction and spaced from one another. The light-emitting elements 1 in the light-emitting unit 100 are dividable into a plurality of light-emitting blocks (e.g., light-emitting block 001 through 160) each including one hundred light-emitting elements 1. In the light-emitting unit 100, DACs 7 are provided in a quantity matching the quantity of the light-emitting element arrays, such that for example, four DACs 001 through 004 are provided for four arrays. Further, the DAC that provides brightness signals SG to light-emitting elements 1 belonging to one of the light-emitting element arrays differs from the DAC that provides brightness signals SG to light-emitting elements belonging to any other one of the light-emitting element arrays.

This is equivalent to a configuration in which a single DAC 7 outputs the brightness signals SG only to one light-emitting element array. Having the brightness signals SG be output only to one light-emitting element array means that there is no need to output the extinguish signal to the other light-emitting element arrays.

Given that there is no need to output the extinguish signal to the other light-emitting element arrays, then there is no need for the single DAC to perform processing to switch sequentially between each of states 2 through 8 for the light-emitting elements belonging to a plurality of different light-emitting element arrays, as is the case in the comparative example. This fact alone enables the circuit configuration to be simplified and enables miniaturization of the overall circuit scale.

Embodiment 2

In Embodiment 1, described above, a configuration is described in which light-emitting elements 1 arranged along the main scanning direction form light-emitting element arrays aligned in the sub scanning direction. However, Embodiment 2 differs from Embodiment 1 in that light-emitting elements 1 arranged along a direction inclined at a predetermined angle with respect to the main scanning direction form light-emitting element arrays aligned in the sub scanning direction. To avoid redundant explanations, the following description omits explanations of content identical to Embodiment 1. Also, identical reference signs are used for identical components.

Figure 14:
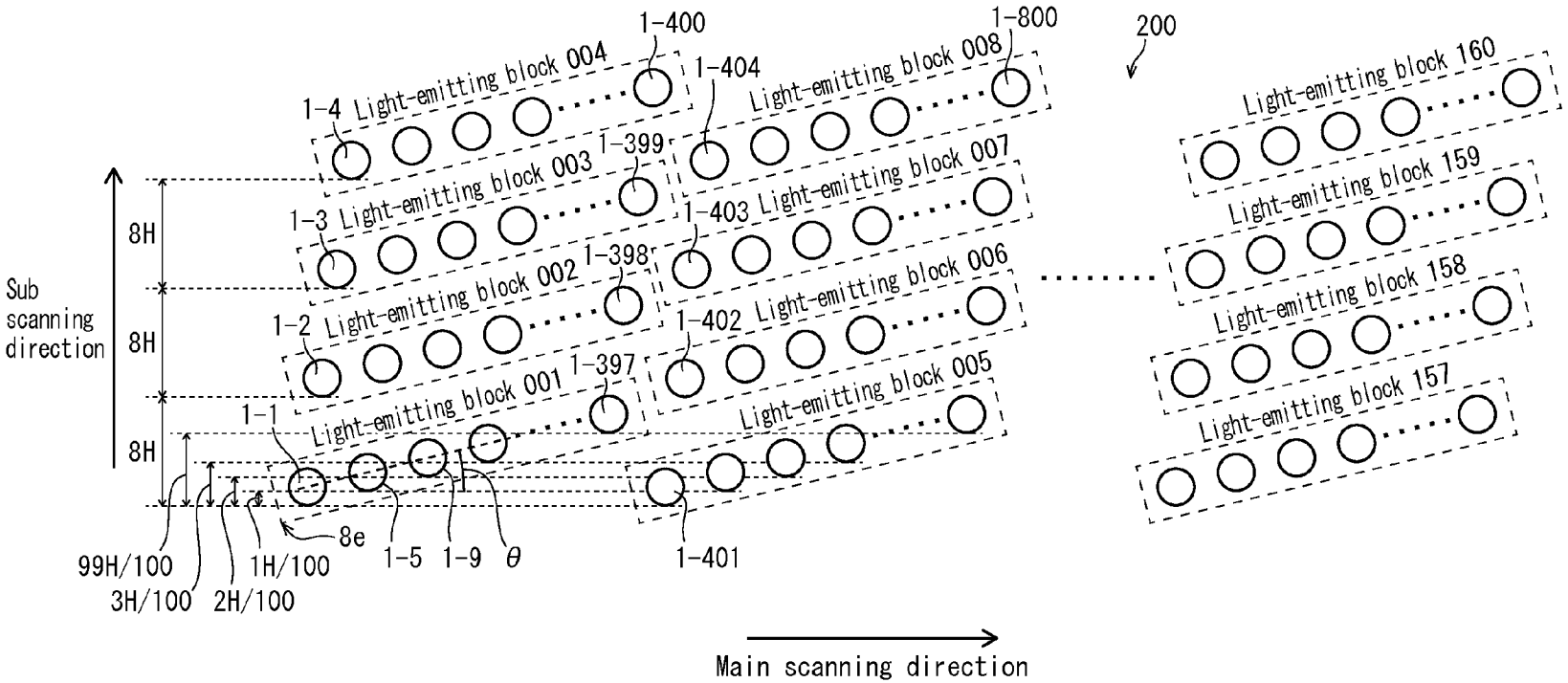
FIG. 14 is a diagram illustrating an example of an arrangement of light-emitting elements in a light-emitting unit pertaining to a second embodiment.

FIG. 14 is a diagram illustrating an example of an arrangement of light-emitting elements 1 in a light-emitting unit 200 pertaining to the second embodiment. Light-emitting blocks 001 through 160 of FIG. 14 correspond to light-emitting blocks 001 through 160 illustrated in FIG. 6. Each light-emitting block includes one hundred light-emitting elements 1.

With attention to light-emitting block 001, light-emitting block 001 is a light-emitting element array 8*e* made up of one hundred light-emitting elements 1-1, 1-5, 1-9, . . . 397, arranged in a direction inclined toward the sub scanning direction at a predetermined angle θ with respect to the main scanning direction. The predetermined angle θ has a size corresponding to an offset in the sub scanning direction between two neighboring light-emitting elements (e.g., 1-1 and 1-5, 1-5 and 1-9, etc.), which is one-hundredth of a distance of displacement by the surface of the photoreceptor drum 11 over time 1H. The same predetermined angle θ is applied to all light-emitting blocks.

This configuration, with the inclined arrangement of the light-emitting element arrays, serves to further improve the reproduction performance of images forming one main scanning line in the original images as a straight line on the photoreceptor drum 11.

That is, in a situation such as that of Embodiment 1, where each light-emitting element array is parallel to the main scanning direction, light-emitting element 1-397 is delayed by a time 99H/100 relative to light-emitting element 1-1 when causing the light-emitting elements 1-1, 1-5, 1-9, . . . 1-397 to emit light in alignment order based on the cycle of the signals ϕ1, ϕ5, and so on from shift register 9*a*, in accordance with image data for one main scanning line. The time 99H/100 corresponds to a sub scanning direction distance of 10.5 μm.

The distance 10.5 μm can be calculated by multiplying the distance (corresponding to the resolution of the sub scanning direction) traveled by the surface of the photoreceptor drum 11 in the rotational direction (i.e., the sub scanning direction) in time 1H, which is 10.6 μm, by 0.99.

Figure 15A:
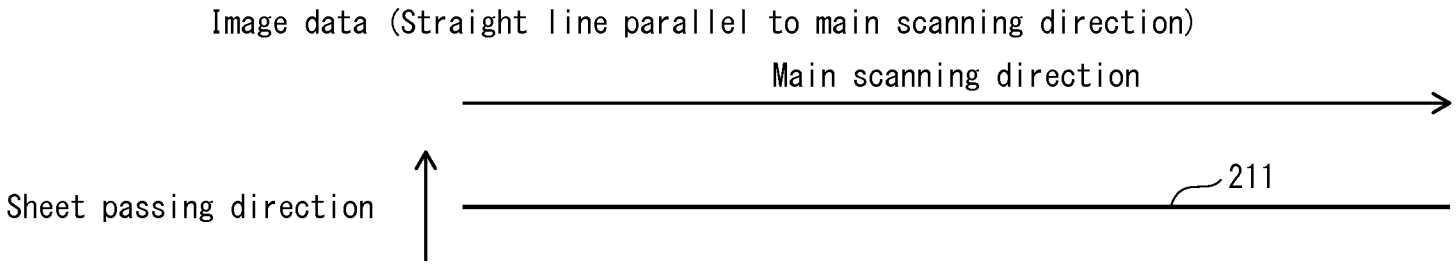
FIG. 15A is a diagram illustrating a linear image that is parallel to a main scanning direction.
Figure 15B:
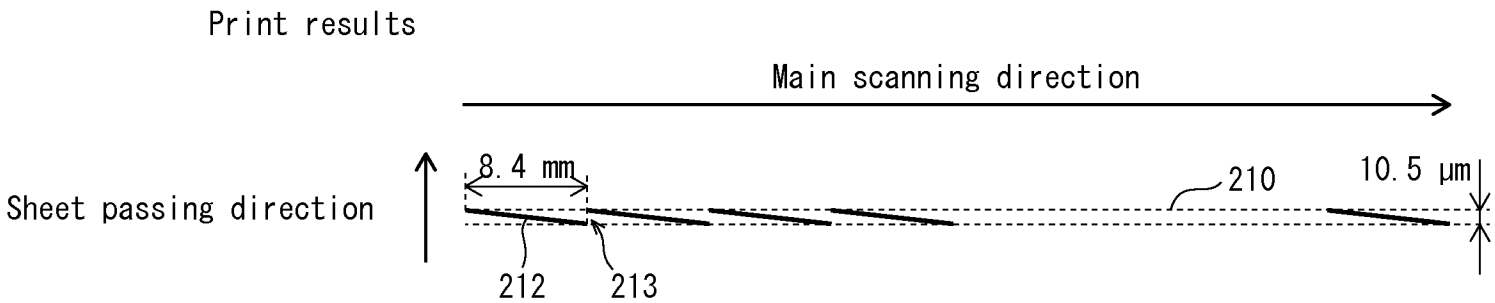
FIG. 15B is a diagram illustrating an example of print results in a situation where writing has been executed in accordance with image data of the linear image that is parallel to the main scanning direction, using a configuration where a light-emitting element array is arranged in parallel to the main scanning direction.
Figure 16:
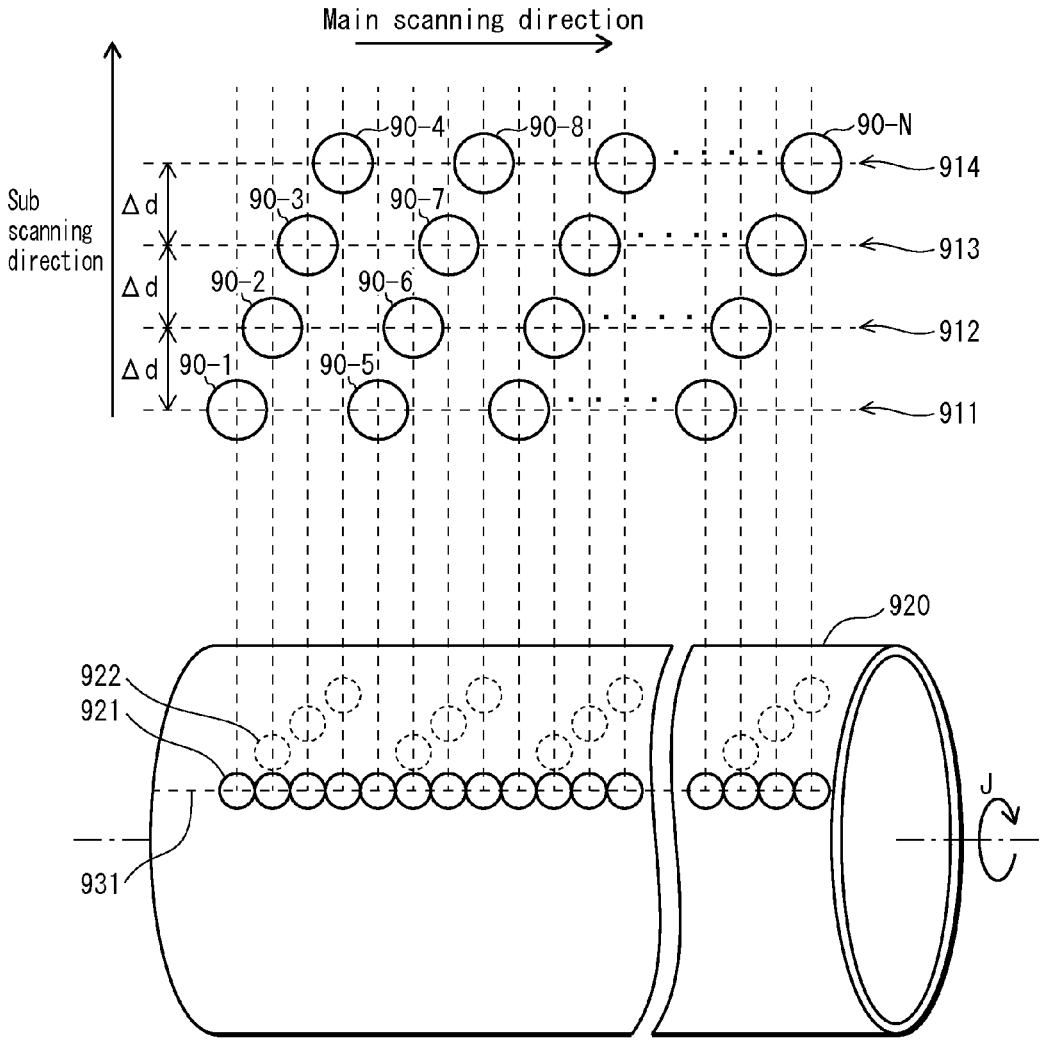
FIG. 16 is a diagram illustrating a configuration example in which a plurality of light-emitting elements have been arranged in a zigzag pattern along the main scanning direction.

Accordingly, given the configuration in which each light-emitting element array is parallel to the main scanning direction, once the writing of the optical beam L is executed by the light-emitting elements 1 in accordance with image data representing a straight line 211 that is parallel to the main scanning direction as illustrated in FIG. 15A, the print result (printed image on the sheet) is as illustrated in FIG. 15B. That is, a plurality of linear images 212 are reproduced, with a gap 213 of 10.5 μm opposite a sheet passing direction formed every 8.4 mm in the main scanning direction.

Here, the value of 8.4 mm is calculated by multiplying the 21 μm resolution in the main scanning direction by 400 pixels (corresponding to 400 light-emitting elements 1 belonging to light-emitting blocks 001 through 004).

The gap 213 of 10.5 μm formed every 8.4 mm in the main scanning direction normally does not create an impression of low image quality as seen by the human eye. However, in an environment where higher-precision reproduction performance of fine lines is sought, the gap 213 may be considered as decreasing the reproduction performance of the fine lines.

As such, Embodiment 2 is configured so that each light-emitting element array is inclined with respect to the main scanning direction, by an angle θ corresponding to the size of the gap 213, which cancels out the gap 213.

In FIG. 14, the value of 8.4 mm in the main scanning direction is 100 times 84 μm, which is the pitch of light-emitting elements 1 in light-emitting block 001, for example. That is, 8.4 mm is substantially equivalent to the distance from light-emitting element 1-1 to light-emitting element 1-397.

As such, light-emitting element array 8*e* is arranged at an incline of angle θ such that, with reference to light-emitting element 1-1 positioned furthest upstream in the sub scanning direction, light-emitting element 1-397 positioned furthest downstream in the sub scanning direction is arranged at an offset of a distance corresponding to the size of the gap 213 (i.e., 10.5 μm) in the sub scanning direction. This results in, for each main scanning line, the beam spot for each light-emitting element 1-1 through 1-397 being irradiated on one straight line on the photoreceptor drum 11 parallel to the main scanning direction.

Specifically, with attention to a single light-emitting block corresponding to one DAC, for instance light-emitting elements 1-1, 1-5, 1-9, . . . 1-397 making up light-emitting block 001, an offset ΔY of the arrangement position in the sub scanning direction for each light-emitting element 1-5, 1-9, . . . 1-397 relative to light-emitting element 1-1 as a reference is given by Math. 1, as follows.

$$\Delta Yk = Dy \times (k-1) \div 100 \qquad \text{(Math. 1)}$$

Here, Dy represents a distance corresponding to the resolution in the sub scanning direction, and is equivalent to the distance traveled by the surface of the photoreceptor drum 11 in the rotational direction (corresponding to the sub scanning direction) during one main scanning period. In the above-described example, Dy is 10.6 μm. The variable k indicates the alignment order of the light-emitting elements 1-1 through 1-397, with light-emitting element 1-1 as a starting point for reference.

For example, offset ΔY2 for light-emitting element 1-5, which is second in alignment order (i.e., k=2), relative to light-emitting element 1-1 has a value of 0.106 μm, which corresponds to (1H/100) as indicated in FIG. 14. Similarly, offset ΔY100 for light-emitting element 1-397, which is hundredth in alignment order, has a value of 10.5 μm, which corresponds to (99H/100) as indicated in FIG. 14.

Math. 1 is an example for a situation in which a single DAC is shared by M light-emitting elements forming a single light-emitting element array, where M is 100. In a situation where M has a value other than 100, the number 100 in Math. 1 is replaced by the value of M, and the variable k (which is an integer) is defined such that $1 \leq k \leq M$. As such, the offset ΔY may be calculated for each of M light-emitting elements forming a single light-emitting element array.

Accordingly, the gap 213 is no longer formed in the linear image reproduced as the print image on the sheet, which enables further improvement to the reproduction performance of the linear image.

The present disclosure is not limited to an optical writing device and an image forming device. For example, the present disclosure may also be used as a method of drive control for light-emitting elements belonging to a light-emitting element array in accordance with a brightness signal supplied from a DAC (i.e., a signal output unit) provided individually for each of a plurality of light-emitting element arrays.

In addition, the method may be a program executed by a computer. Furthermore, a program pertaining to the present disclosure may be recorded on any of various types of computer-readable recording media, such as magnetic tape, a magnetic disc such as a floppy disc, an optical disc such as a DVD-ROM, a DVD-RAM, a CD-ROM, a CD-R, an MO, and a PD, and so on. The program may be produced, distributed, and so on in recording medium format, and may also be delivered and supplied in program format via various wired and wireless networks including the Internet, via broadcast, via electronic communication lines, via satellite transmission, and so on.

(Variations)

The present disclosure has been described above in terms of the Embodiments. However, the present disclosure is, of course, not limited to the Embodiments. The following variations are also plausible.

(1) In the above-described Embodiments, the processing for delaying the output start timing of the brightness signals SG for light-emitting elements 1*b*, 1*c*, 1*d* belonging to the light-emitting element arrays 8*b*, 8*c*, 8*d* of the second, third, and fourth zigzag tiers by a predetermined time (i.e., 8H, 16H, and 24H) for each light-emitting element array relative to light-emitting element array 8*a* of the first zigzag tier is handled by DACs 7 each serving as a signal output unit corresponding to each of the second, third, and fourth zigzag tiers. However, no such limitation is intended. For example, the brightness signal output unit 51 may delay the brightness signals SG by the predetermined time (i.e., 8H, 16H, and so on) and then output the signals to the DACs 7 corresponding to the second, third, and fourth zigzag tiers. In such a situation, a combination of the brightness signal output unit 51 and each of the DACs 7 forms a signal output unit.

(2) In the above-described Embodiments, the light-emitting unit 100 is described as having a configuration example including four light-emitting element arrays 8*a*, 8*b*, 8*c*, 8*d*. However, the light-emitting element arrays are not limited to being four in number, provided that a plurality of arrays are present.

For example, in a situation where the rod lens array 62 serving as an optical system has uniform optical transmittance over an area on the order of 500 μm or less in the sub scanning direction, the zigzag pattern may be arranged with a maximum of six tiers.

(3) In the above-described Embodiments, an example is described in which current driven OLEDs, with an amount of emitted light that changes in response to an amount of current flowing (i.e., the magnitude of the current) are used as the light-emitting elements 1. However, no such limitation is intended. Other types of components, such as LEDs and so on, may also be used as the light-emitting elements.

Further, the plurality of light-emitting elements may form a plurality of light-emitting element arrays spaced from one another in the sub scanning direction, and may be offset from one another at a predetermined pitch in the main scanning direction such that the light-emitting elements have a mutually-offset positional relationship in the main scanning direction.

In addition, the drive circuit 2 is described in a configuration example where a field-effect transistor (hereinafter, FET) is used. However, another type of voltage driven circuit may also be used. Also, the relationships between magnitudes of the voltages described above, the circuit configurations described above, and the circuit components described above are non-limiting examples.

Furthermore, a condenser is used as the holding element 6. However, no such limitation is intended. Any element may be used as the holding element 6, provided that the element holds a charge in accordance with voltage or current of the brightness signal SG through the writing of the brightness signal SG indicating the amount of light for the corresponding light-emitting element 1.

In addition, the light-emitting elements 1, the drive circuits 2 and the switch elements 5 each made up of a TFT, and so on are described as being formed on a common TFT substrate 71. However, a different circuit configuration may also be used. Also, a micro-lens array may also be used as the optical system, instead of the rod lens array 62.

(4) In addition, a configuration example is described where a single shift register 9*a* serves as a switching unit controlling the switch elements 5 for the one hundred light-emitting elements 1-1, 1-5, 1-9, and so on forming one light-emitting element array and belonging to the first zigzag tier and the switch elements 5 for the one hundred light-emitting elements 1-2, 1-6, 1-10, and so on forming one light-emitting element array and belonging to the second zigzag tier. However, no such limitation is intended. A configuration in which a single shift register corresponds to one or to three or more light-emitting element arrays may also be used.

Furthermore, a single DAC 7 is described as shared among one hundred light-emitting elements 1. However, the number of light-emitting elements sharing one signal DAC 7 is not limited to one hundred, and may be any number at least one.

In addition, a configuration has been described above such that, in order to reduce the processing load on the DACs and the shift registers, a total of 4000 of the light-emitting elements belonging to one light-emitting element array are divided into forty light-emitting blocks of one hundred elements each, in alignment order. Also, a single DAC is provided in correspondence with each light-emitting block, and a single shift register is provided in association with two of the light-emitting blocks. However, no such limitation is intended.

For example, a single DAC and a single shift register may be provided in correspondence with a plurality of light-emitting blocks belonging to the same light-emitting element array (e.g., light-emitting blocks 001, 005, and so on).

Furthermore, a configuration in which a single DAC and a plurality of shift registers are associated with one light-emitting block is also possible. In a situation where such a configuration is used, a plurality, e.g., one hundred, of light-emitting elements 1 belonging to a single light-emitting block may be divided into a plurality of light-emitting element groups, each made up of a plurality of light-emitting elements aligned in an alignment direction. The configuration may then provide separate shift registers for each of the light-emitting element groups.

(5) In the above-described Embodiment, the optical writing device is described in a configuration example used in a printer 55. However, no such limitation is intended. For example, the optical writing device is also applicable to use in an image forming device such as a photocopier or multi-function peripheral (MFP) having a photoreceptor serving as a displaceable body, such as the photoreceptor drum 11, to which a latent static image or the like is written by an optical beam. In addition, no limitation to an image forming device is intended. The present disclosure is generally applicable to a device performing optical writing to a photoreceptor using an optical beam.

Also, the contents of the above-described Embodiments and the above-described variations may be freely combined within the scope of possibility.

(Summary)

The above-described Embodiments and variations describe one aspect of a solution to the problem described in the discussion of the related art. These Embodiments and variations are described as follows.

One aspect of the present disclosure is an optical writing device performing optical writing onto a photoreceptor, including: a light-emitting unit including a plurality of light-emitting elements that form a plurality of element rows spaced from one another in a sub scanning direction, each of the light-emitting elements having a main scanning direction position differing from a main scanning direction position of any other one of the light-emitting elements; a plurality of signal output units, one for each element row, each signal output unit outputting a light amount signal for each light-emitting element in a corresponding element row, each light amount signal indicating an amount of light to be emitted by a corresponding light-emitting element; and a plurality of drive units, one for each light-emitting element, each drive unit, when receiving a light amount signal for a corresponding light-emitting element, supplying a drive current in accordance with the light amount signal to the corresponding light-emitting element.

In the optical writing device pertaining to one aspect of the present disclosure, each drive unit, corresponding to one light-emitting element, may include: a holding element receiving writing of a light amount signal for the one light-emitting element and holding the light-amount signal therein; and a drive circuit controlling an electric current from a power supply in accordance with the light amount signal held in the holding element to acquire the drive current, and supplying the drive current to the one light-emitting element.

In the optical writing device pertaining to one aspect of the present disclosure, during each main scanning period, each signal output unit may output a light amount signal for each light-emitting element in a corresponding element row, and each holding element, corresponding to one light-emitting element, may receive writing of a light amount signal for the one light-emitting element and hold the light amount signal therein, the light amount signal replacing a light amount signal for the one light-emitting element output during a previous main scanning period, and each drive circuit, during a period from when a light amount signal output during the previous main scanning period is written to a holding unit in a same drive unit until a light amount signal output during the main scanning period is written to the holding unit in the same drive unit, may control the electric current from the power supply such that the drive current is in accordance with the light amount signal output during the previous main scanning period.

The optical writing device pertaining to one aspect of the present disclosure may further include: a plurality of signal lines, one for each signal output unit, each signal line extending from a corresponding signal output unit to an element row corresponding to the signal output unit; and a switching unit, each signal output unit may output light-amount signals for respective light-emitting elements in a corresponding element row one after another via a corresponding signal line, each drive unit, corresponding to one light-emitting element, may include a switch element that switches between a connection state and a disconnection state, the switch element, in the connection state, connecting a holding element in a same drive unit to a signal line extending to an element row including the one light-emitting element, and in the disconnection state, not connecting the holding element in the same drive unit to the signal line extending to the element row including the one light-emitting element, and the switching unit may execute switching control each time a signal output unit outputs a light amount signal for one light-emitting element in a corresponding element row via a corresponding signal line, such that only a switching element in a drive unit corresponding to the one light-emitting element switches to the connection state while switching elements in drive units corresponding to the rest of the light-emitting elements in the corresponding element row remain in the disconnection state.

In the optical writing device pertaining to one aspect of the present disclosure, the switching unit may include one or more shift registers, and when each signal output unit outputs light amount signals for respective light-emitting elements in a corresponding element row one after another via a corresponding signal line, one of the one or more shift registers may output instruction signals to switch elements in drive units each corresponding to one of the light-emitting elements in the corresponding element row one after another, the instruction signals causing the switch elements to switch from the disconnection state to the connection state one after another in an order that is in accordance with an order in which the signal output unit outputs the light amount signals.

In the optical writing device pertaining to one aspect of the present disclosure, the element rows may at least include a first element row and a second element row, and the one or more shift registers may include one shift register that sequentially outputs instruction signals each being input to both a switch element in a drive unit corresponding to one light-emitting element in the first element row and a switch element in a drive unit corresponding to one light-emitting element in the second element row.

In the optical writing device pertaining to one aspect of the present disclosure, each element row may be composed of two or more element groups, each element group composed of two or more light-emitting elements that are adjacent to one another, and the one or more shift registers may each correspond to one light-emitting element group.

In the optical writing device pertaining to one aspect of the present disclosure, at least one drive unit may be arranged at each of two areas opposing each other with the light-emitting unit therebetween.

In the optical writing device pertaining to one aspect of the present disclosure, each element row may be composed of light-emitting elements arranged along the main scanning direction, or each element row may be composed of light-emitting elements arranged along a direction inclined at a predetermined angle relative to the main scanning direction.

In the optical writing device pertaining to one aspect of the present disclosure, each element row may be composed of light-emitting elements arranged along a direction inclined at a predetermined angle relative to the main scanning direction, and in each element row, when: M denotes the number of light-emitting elements composing the element row; k ($1 \le k \le M$) is assigned sequentially to the light-emitting elements composing the element row, starting from k=1 being assigned to a reference light-emitting element that is located most upstream in the sub scanning direction among the light-emitting elements composing the element row; and Dy denotes a distance that a given point at a surface of the photoreceptor travels in the sub scanning direction during one main scanning period, light-emitting elements each indicated by k within a range of $2 \le k \le M$, being light-emitting elements other than the reference light-emitting element in the element row, may be each offset with respect to the reference light-emitting element in the sub scanning direction by an offset amount $\Delta Yk$ satisfying $\Delta Yk = Dy \times ((k-1)/M)$.

In the optical writing device pertaining to one aspect of the present disclosure, the element rows may at least include an upstream element row and a downstream element row that are adjacent to one another in the sub scanning direction and spaced from one another in the sub scanning direction by a predetermined distance, and output of light amount signals for respective light-emitting elements in the downstream element row by a corresponding signal output unit may be delayed with respect to output of light amount signals for respective light-emitting elements in the upstream element row by a corresponding signal output unit, the delay corresponding to the predetermined distance between the upstream element row and the downstream element row.

In the optical writing device pertaining to one aspect of the present disclosure, the light-emitting elements may be organic light-emitting diodes.

Another aspect of the present disclosure is an image forming device writing an image to a photoreceptor with light from the optical writing device pertaining to one aspect of the present disclosure.

According to the above-described configuration, each signal output unit supplies light amount signals only to drive units corresponding to light-emitting elements belonging to the corresponding light-emitting element array. Accordingly, there is no need to perform switching management between light-emitting and extinguishing for each light-emitting element in each light-emitting element array in accordance with a plurality of different states having different timing, as described in the discussion of the related art. This enables miniaturization of the circuit scale as no complex circuits are required.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An optical writing device performing optical writing onto a photoreceptor, the optical writing device comprising:

a light-emitting unit including a plurality of light-emitting elements that form a plurality of element rows spaced from one another in a sub scanning direction, each of the light-emitting elements having a main scanning direction position differing from a main scanning direction position of any other one of the light-emitting elements;

a plurality of signal output units, one for each element row, each signal output unit outputting a light amount signal for each light-emitting element in a corresponding element row, each light amount signal indicating an amount of light to be emitted by a corresponding light-emitting element; and a plurality of drive units, one for each light-emitting element, each drive unit, when receiving a light amount signal for a corresponding light-emitting element, supplying a drive current in accordance with the light amount signal to the corresponding light-emitting element;

wherein:

each drive unit, corresponding to one light-emitting element, includes:

a holding element receiving writing of a light amount signal for the one light-emitting element and holding the light-amount signal therein; and a drive circuit controlling an electric current from a power supply in accordance with the light amount signal held in the holding element to acquire the drive current, and supplying the drive current to the one light-emitting element; and wherein during each main scanning period, each signal output unit outputs a light amount signal for each light-emitting element in a corresponding element row, and each holding element, corresponding to one light-emitting element, receives writing of a light amount signal for the one light-emitting element and holds the light amount signal therein, the light amount signal replacing a light amount signal for the one light-emitting element output during a previous main scanning period, and each drive circuit, during a period from when a light amount signal output during the previous main scanning period is written to a holding unit in a same drive unit until a light amount signal output during the main scanning period is written to the holding unit in the same drive unit, controls the electric current from the power supply such that the drive current is in accordance with the light amount signal output during the previous main scanning period.

2. An optical writing device performing optical writing onto a photoreceptor, the optical writing device comprising:

a light-emitting unit including a plurality of light-emitting elements that form a plurality of element rows spaced from one another in a sub scanning direction, each of the light-emitting elements having a main scanning direction position differing from a main scanning direction position of any other one of the light-emitting elements;

a plurality of signal output units, one for each element row, each signal output unit outputting a light amount signal for each light-emitting element in a corresponding element row, each light amount signal indicating an amount of light to be emitted by a corresponding light-emitting element; and a plurality of drive units, one for each light-emitting element, each drive unit, when receiving a light amount signal for a corresponding light-emitting element, supplying a drive current in accordance with the light amount signal to the corresponding light-emitting element;

wherein:

each drive unit, corresponding to one light-emitting element, includes:

a holding element receiving writing of a light amount signal for the one light-emitting element and holding the light-amount signal therein; and a drive circuit controlling an electric current from a power supply in accordance with the light amount signal held in the holding element to acquire the drive current, and supplying the drive current to the one light-emitting element; and the optical writing device further comprising:

a plurality of signal lines, one for each signal output unit, each signal line extending from a corresponding signal output unit to an element row corresponding to the signal output unit; and a switching unit, wherein each signal output unit outputs light-amount signals for respective light-emitting elements in a corresponding element row one after another via a corresponding signal line, each drive unit, corresponding to one light-emitting element, includes a switch element that switches between a connection state and a disconnection state, the switch element, in the connection state, connecting a holding element in a same drive unit to a signal line extending to an element row including the one light-emitting element, and in the disconnection state, not connecting the holding element in the same drive unit to the signal line extending to the element row including the one light-emitting element, and the switching unit executes switching control each time a signal output unit outputs a light amount signal for one light-emitting element in a corresponding element row via a corresponding signal line, such that only a switching element in a drive unit corresponding to the one light-emitting element switches to the connection state while switching elements in drive units corresponding to the rest of the light-emitting elements in the corresponding element row remain in the disconnection state.

3. The optical writing device of claim 2, wherein the switching unit includes one or more shift registers, and when each signal output unit outputs light amount signals for respective light-emitting elements in a corresponding element row one after another via a corresponding signal line, one of the one or more shift registers outputs instruction signals to switch elements in drive units each corresponding to one of the light-emitting elements in the corresponding element row one after another, the instruction signals causing the switch elements to switch from the disconnection state to the connection state one after another in an order that is in accordance with an order in which the signal output unit outputs the light amount signals.

4. The optical writing device of claim 3, wherein the element rows at least include a first element row and a second element row, and the one or more shift registers include one shift register that sequentially outputs instruction signals each being input to both a switch element in a drive unit corresponding to one light-emitting element in the first element row and a switch element in a drive unit corresponding to one light-emitting element in the second element row.

5. The optical writing device of claim 3, wherein each element row is composed of two or more element groups, each element group composed of two or more light-emitting elements that are adjacent to one another, and the one or more shift registers each correspond to one light-emitting element group.

6. The optical writing device of claim 1, wherein at least one of the plurality of drive units is arranged at each of two areas opposing each other with the light-emitting unit therebetween.

7. An optical writing device performing optical writing onto a photoreceptor, comprising:

a light-emitting unit including a plurality of light-emitting elements that form a plurality of element rows spaced from one another in a sub scanning direction, each of the light-emitting elements having a main scanning direction position differing from a main scanning direction position of any other one of the light-emitting elements;

a plurality of signal output units, one for each element row, each signal output unit outputting a light amount signal for each light-emitting element in a corresponding element row, each light amount signal indicating an amount of light to be emitted by a corresponding light-emitting element; and a plurality of drive units, one for each light-emitting element, each drive unit, when receiving a light amount signal for a corresponding light-emitting element, supplying a drive current in accordance with the light amount signal to the corresponding light-emitting element;

wherein each element row is composed of light-emitting elements arranged along the main scanning direction, or each element row is composed of light-emitting elements arranged along a direction inclined at a predetermined angle relative to the main scanning direction wherein each element row is composed of light-emitting elements arranged along a direction inclined at a predetermined angle relative to the main scanning direction, and in each element row, when:

M denotes the number of light-emitting elements composing the element row;

k ($1 \leq k \leq M$) is assigned sequentially to the light-emitting elements composing the element row, starting from k=1 being assigned to a reference light-emitting element that is located most upstream in the sub scanning direction among the light-emitting elements composing the element row; and Dy denotes a distance that a given point at a surface of the photoreceptor travels in the sub scanning direction during one main scanning period, light-emitting elements each indicated by k within a range of $2 \leq k \leq M$, being light-emitting elements other than the reference light-emitting element in the element row, are each offset with respect to the reference light-emitting element in the sub scanning direction by an offset amount $\Delta Yk$ satisfying $\Delta Yk = Dy \times ((k-1)/M)$.

8. An optical writing device performing optical writing onto a photoreceptor, comprising:

a light-emitting unit including a plurality of light-emitting elements that form a plurality of element rows spaced from one another in a sub scanning direction, each of the light-emitting elements having a main scanning direction position differing from a main scanning direction position of any other one of the light-emitting elements;

a plurality of signal output units, one for each element row, each signal output unit outputting a light amount signal for each light-emitting element in a corresponding element row, each light amount signal indicating an amount of light to be emitted by a corresponding light-emitting element; and a plurality of drive units, one for each light-emitting element, each drive unit, when receiving a light amount signal for a corresponding light-emitting element, supplying a drive current in accordance with the light amount signal to the corresponding light-emitting element;

wherein:

the element rows at least include an upstream element row and a downstream element row that are adjacent to one another in the sub scanning direction and spaced from one another in the sub scanning direction by a predetermined distance, and output of light amount signals for respective light-emitting elements in the downstream element row by a corresponding signal output unit is delayed with respect to output of light amount signals for respective light-emitting elements in the upstream element row by a corresponding signal output unit, the delay corresponding to the predetermined distance between the upstream element row and the downstream element row.

9. The optical writing device according to claim 8, wherein the light-emitting elements are organic light-emitting diodes.

10. An image forming device writing an image to a photoreceptor with light from an optical writing device, wherein the optical writing device is the optical writing device according to claim 1.

11. The optical writing device according to claim 1, wherein the light-emitting elements are organic light-emitting diodes.

12. The optical writing device according to claim 2, wherein the light-emitting elements are organic light-emitting diodes.

13. The optical writing device according to claim 7, wherein the light-emitting elements are organic light-emitting diodes.

14. The optical writing device of claim 2, wherein at least one of the plurality of drive units is arranged at each of two areas opposing each other with the light-emitting unit therebetween.

15. The optical writing device of claim 7, wherein at least one of the plurality of drive units is arranged at each of two areas opposing each other with the light-emitting unit therebetween.

16. The optical writing device of claim 8, wherein at least one of the plurality of drive units is arranged at each of two areas opposing each other with the light-emitting unit therebetween.

17. An image forming device writing an image to a photoreceptor with light from an optical writing device, wherein the optical writing device is the optical writing device according to claim 2.

18. An image forming device writing an image to a photoreceptor with light from an optical writing device, wherein the optical writing device is the optical writing device according to claim 7.

19. An image forming device writing an image to a photoreceptor with light from an optical writing device, wherein the optical writing device is the optical writing device according to claim 8.

* * * * *